US008218989B2

(12) United States Patent
Fujita

(10) Patent No.: US 8,218,989 B2
(45) Date of Patent: Jul. 10, 2012

(54) IMAGE FORMING APPARATUS THAT TRANSFERS TONER IMAGE CARRIED BY IMAGE CARRIER ONTO SHEET, DENSITY CONTROL METHOD THEREFOR, AND STORAGE MEDIUM

(75) Inventor: Sadao Fujita, Tokyo (JP)

(73) Assignee: Canon Kabushiki Kaisha (JP)

( * ) Notice: Subject to any disclaimer, the term of this patent is extended or adjusted under 35 U.S.C. 154(b) by 108 days.

(21) Appl. No.: 12/825,927

(22) Filed: Jun. 29, 2010

(65) Prior Publication Data

US 2011/0002704 A1 Jan. 6, 2011

(30) Foreign Application Priority Data

Jul. 1, 2009 (JP) ..... 2009-156770

(51) Int. Cl.
*G03G 15/00* (2006.01)

(52) U.S. Cl. ..... 399/49; 399/302

(58) Field of Classification Search ..... 399/49, 399/60, 302, 308
See application file for complete search history.

(56) References Cited

U.S. PATENT DOCUMENTS

| | | | |
|---|---|---|---|
| 2004/0057739 | A1 | 3/2004 | Shimura |
| 2004/0105689 | A1 | 6/2004 | Shimura et al. |
| 2008/0089702 | A1 * | 4/2008 | Takezawa et al. ..... 399/32 |

FOREIGN PATENT DOCUMENTS

| | | | |
|---|---|---|---|
| EP | 1 387 222 | A2 | 2/2004 |
| EP | 1 400 863 | A2 | 3/2004 |
| JP | 2005-148299 | A | 6/2005 |
| JP | 2005-345740 | A | 12/2005 |

OTHER PUBLICATIONS

Extended European Search Report issued in corresponding European Patent Application No. 10168104.7 dated Jan. 19, 2011.

* cited by examiner

*Primary Examiner* — Sophia S Chen

(74) *Attorney, Agent, or Firm* — Rossi, Kimms & McDowell LLP

(57) ABSTRACT

An image forming apparatus capable of identifying the amount of reflected light from any portion of an image carrier in a short time. A sensor detects reflected light from an intermediate transfer belt. A CPU performs pattern matching between the amount of reflected light from the belt corresponding to one rotation thereof and the amount of reflected light from a specific portion of the belt to thereby identify a first circumferential location of the specific portion and a second circumferential location of a toner patch formed on the belt. The CPU calculates toner patch density based on the amount of reflected light from the toner patch and the amount of reflected light from the belt in the second circumferential location. The density of a toner image to be formed on the belt is controlled according to the calculated toner patch density.

13 Claims, 16 Drawing Sheets

| DATA NUMBER n | OUTPUT |
|---|---|
| 0 | 421 |
| 1 | 418 |
| 2 | 419 |
| ... | ... |
| 909 | 428 |

| DATA NUMBER n | OUTPUT |
|---|---|
| 0 | 433 |
| 1 | 411 |
| 2 | 412 |
| ... | ... |
| 79 | 423 |

IMAGE FORMING APPARATUS THAT TRANSFERS TONER IMAGE CARRIED BY IMAGE CARRIER ONTO SHEET, DENSITY CONTROL METHOD THEREFOR, AND STORAGE MEDIUM

BACKGROUND OF THE INVENTION

1. Field of the Invention

The present invention relates to an image forming apparatus adapted to transfer a toner image carried by an image carrier onto a sheet, and a density control method for the image forming apparatus.

2. Description of the Related Art

Conventionally, in an image forming apparatus, such as a copying machine or a printer utilizing electrophotography, the density of an image has been corrected in the following manner: A toner image is formed for density correction (i.e. a toner patch) on an image carrier, such as a photosensitive drum or an intermediate transfer member, and the toner patch is detected by an optical sensor to thereby generate correction data.

In the case of determining the density of a toner patch, it is required to grasp the amount of reflected light from a portion of the image carrier reflected light from a portion of the image carrier where the toner patch is to be formed, i.e. from a so-called background, in advance. This is because an output from the sensor having detected the toner patch also contains reflected light from the background.

The photosensitive drum and the intermediate transfer member are glossy, so that much of light irradiated onto the photosensitive drum or the intermediate transfer member is reflected therefrom to be read by the optical sensor. In particular, a low-density image is expressed by reducing the amount of toner, and hence the degree of exposure of a background on which a low-density toner patch is formed is higher than that of a background on which a high-density toner patch is formed. For this reason, in order to calculate the density of a low-density toner patch accurately, it is required to detect the density of the toner patch while taking into account the amount of reflected light from its background.

Conventionally, there has been proposed a method in which a home position mark provided on an image carrier is detected by an optical sensor to thereby obtain the positional relationship between the home position of the image carrier for a rotation thereof and a toner patch, and then the amount of reflected light from the background of the toner patch is identified based on the positional relationship (see Japanese Laid-Open Patent Publication No. 2005-345740).

In this method, surface conditions of the image carrier during one rotation of the same are detected as a profile in advance. Further, an output indicative of reflected light from the background of the toner patch is identified based on the positional relationship between the home position and the toner patch and the profile of the surface conditions of the image carrier detected in advance over one rotation of the image carrier, and the density of the toner patch is detected based on the identified output indicative of reflected light from the background and the result of detection of the toner patch.

Further, conventionally, there has been proposed an apparatus which does not use the above-mentioned home position mark (see Japanese Laid-Open Patent Publication No. 2005-148299). In this apparatus, background data corresponding to one rotation of an intermediate transfer member is measured, and then image density detection data corresponding to one rotation of the intermediate transfer member having a toner patch formed thereon is measured. Thereafter, alignment between the background data and the image density detection data is performed based on a correlation between the two data. Thus, background data on a portion of the intermediate transfer member where the toner patch is formed is identified based on the result of the alignment.

However, the conventional image forming apparatuses described above suffer from the following problems: In the image forming apparatus disclosed in Japanese Laid-Open Patent Publication No. 2005-345740, if the home position mark is lost due to fall-off or abrasion, it becomes impossible to perform density correction by taking reflected light from the background into account. Further, it takes cost to attach the home position mark.

On the other hand, in the image forming apparatus disclosed in Japanese Laid-Open Patent Publication No. 2005-148299, after acquisition of the background data, it is required to cause the intermediate transfer member to perform one more rotation with the toner patch formed thereon, so as to acquire data for density correction, and therefore it takes time to perform density correction.

SUMMARY OF THE INVENTION

The present invention provides an image forming apparatus which is capable of identifying the amount of reflected light from a desired portion of an image carrier in a short time by a simplified construction, and a density control method for the image forming apparatus.

In a first aspect of the present invention, there is provided an image forming apparatus that transfers a toner image carried by an image carrier onto a sheet, comprising a photo detector unit disposed in facing relation to the image carrier, for detecting reflected light from the image carrier, a circumferential location identification unit adapted to perform pattern matching between amounts of reflected light detected by the photo detector unit during one rotation of the image carrier and an amount of reflected light detected by the photo detector unit from a specific portion of the image carrier in a circumferential direction of the image carrier, to thereby identify a first circumferential location of the specific portion of the image carrier in the circumferential direction of the image carrier and then identify a second circumferential location of a detection toner image formed on the image carrier based on the identified first circumferential location, a density calculation unit adapted to calculate density of the detection toner image based on an amount of reflected light from the detection toner image, which is detected by the photo detector unit, and an amount of reflected light from a portion of the image carrier in the second circumferential location identified by the circumferential location identification unit, out of amounts of reflected light from the image carrier corresponding to one rotation of the image carrier, which are detected by the photo detector unit, and a density control unit adapted to control density of a toner image to be formed on the image carrier, according to the density of the detection toner image calculated by said density calculation unit.

The image forming apparatus according to the first aspect of the present invention performs pattern matching between the amount of reflected light from the specific portion of the image carrier and the amounts of reflected light from the image carrier corresponding to one rotation thereof to thereby identify the first circumferential location, and then identifies the second circumferential location of the detection toner image based on the identified first circumferential location. Thus, the image forming apparatus can identify the amount of reflected light from any portion of the image carrier in a short time with the simplified construction, which makes it possible to easily acquire the amount of reflected light from a portion of the image carrier to be used as a background for the detection toner image.

In a second aspect of the present invention, there is provided a density control method for an image forming apparatus that is adapted to transfer a toner image carried by an image carrier onto a sheet, and includes a photo detector unit disposed in facing relation to the image carrier, comprising detecting reflected light from the image carrier by the photo detector unit, performing pattern matching between amounts of reflected light detected by the photo detector unit during one rotation of the image carrier and an amount of reflected light detected by the photo detector unit from a specific portion of the image carrier in a circumferential direction of the image carrier, to thereby identify a first circumferential location of the specific portion of the image carrier in the circumferential direction of the image carrier and then identify a second circumferential location of a detection toner image formed on the image carrier based on the identified first circumferential location, calculating density of the detection toner image based on an amount of reflected light from the detection toner image, which is detected by the photo detector unit, and an amount of reflected light from a portion of the image carrier in the identified second circumferential location, out of amounts of reflected light from the image carrier corresponding to one rotation of the image carrier, which are detected by the photo detector unit, and controlling density of a toner image to be formed on the image carrier, according to the calculated density of the detection toner image.

According to the density control method of the second aspect of the present invention, it is possible to obtain the same advantageous effect as provided in the first aspect.

In a third aspect of the present invention, there is provided a non-transitory computer-readable storage medium storing a program which, on execution by a programmable image forming apparatus that is adapted to transfer a toner image carried by an image carrier onto a sheet, and includes a photo detector unit disposed in facing relation to the image carrier, causes the programmable image forming apparatus to carry out a density control method comprising detecting reflected light from the image carrier by the photo detector unit, performing pattern matching between amounts of reflected light detected by the photo detector unit during one rotation of the image carrier and an amount of reflected light detected by the photo detector unit from a specific portion of the image carrier in a circumferential direction of the image carrier, to thereby identify a first circumferential location of the specific portion of the image carrier in the circumferential direction of the image carrier and then identify a second circumferential location of a detection toner image formed on the image carrier based on the identified first circumferential location, calculating density of the detection toner image based on an amount of reflected light from the detection toner image, which is detected by the photo detector unit, and an amount of reflected light from a portion of the image carrier in the identified second circumferential location, out of amounts of reflected light from the image carrier corresponding to one rotation of the image carrier, which are detected by the photo detector unit, and controlling density of a toner image to be formed on the image carrier, according to the calculated density of the detection toner image.

According to the non-transitory computer-readable storage medium of the third aspect of the present invention, it is possible to obtain the same advantageous effect as provided in the first aspect.

Further features of the present invention will become apparent from the following description of exemplary embodiments (with reference to the attached drawings).

DETAILED DESCRIPTION OF THE EMBODIMENTS

The present invention will now be described in detail below with reference to the accompanying drawings showing embodiments thereof.

Figure 1:
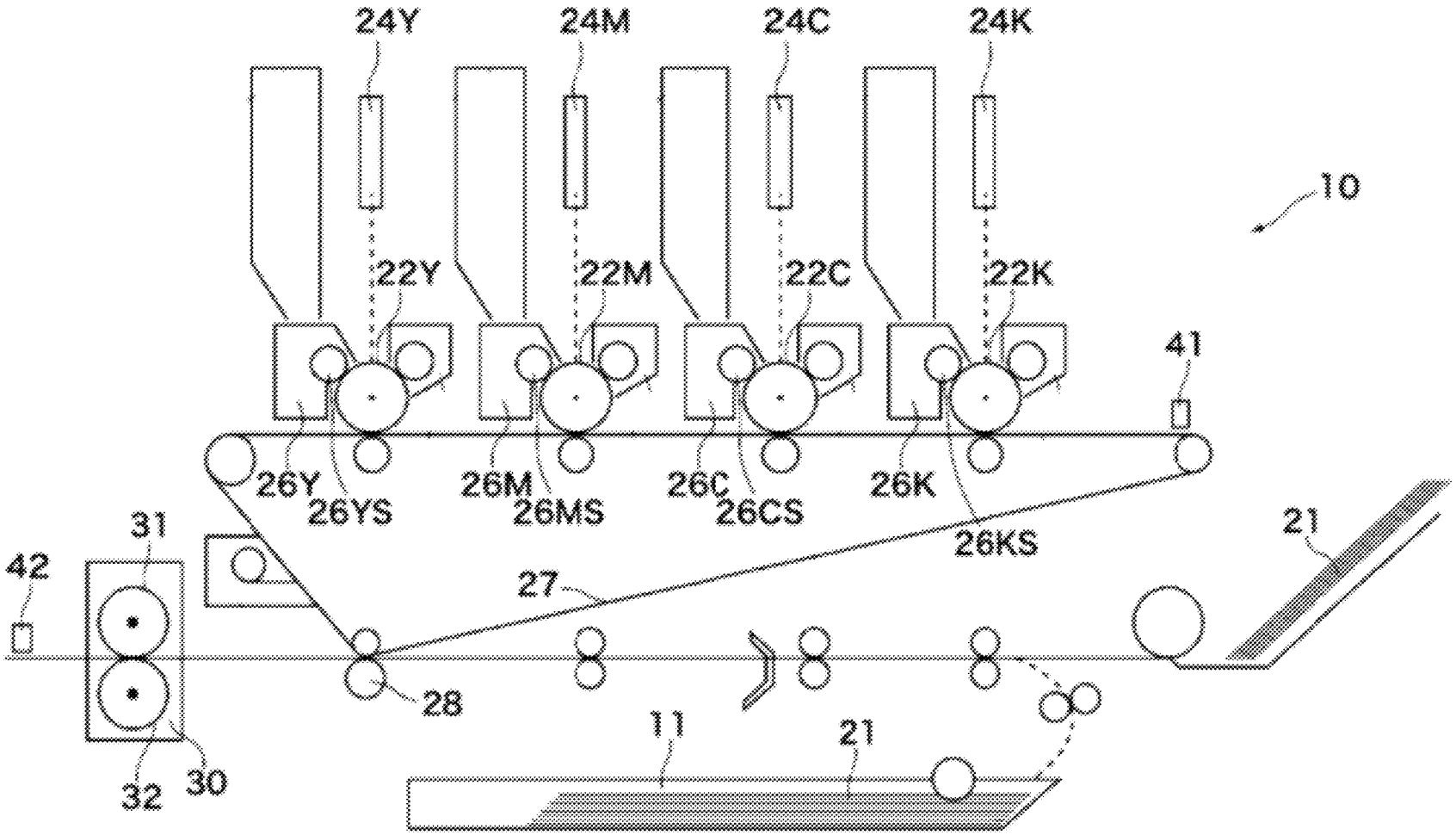
FIG. 1 is a schematic view of image forming units of an image forming apparatus according to a first embodiment of the present invention.

FIG. 1 is a schematic view of image forming units of an image forming apparatus according to a first embodiment of the present invention. This image forming apparatus is, for example, implemented by an electrophotographic color image forming apparatus (printer) which employs an intermediate transfer belt 27 (image carrier) and has tandem image forming units 10 of four colors, i.e. yellow, magenta, cyan, and black.

Each laser beam source 24 emits a laser beam based on a digital signal from a document reader (not shown) to form an electrostatic latent image on an associated photosensitive drum 22 uniformly charged by an associated primary electrostatic charger 23. The tandem color image forming apparatus of the present embodiment is provided with a yellow-associated laser beam source 24Y, a magenta-associated laser beam source 24M, a cyan-associated laser beam source 24C, and a black-associated laser beam source 24K associated with the respective colors. Similarly, the tandem color image forming apparatus is provided with a yellow-associated photosensitive drum 22Y, a magenta-associated photosensitive drum 22M, a cyan-associated photosensitive drum 22C, and a black-associated photosensitive drum 22K, which are associated with the respective colors. It should be noted that the laser beam sources 24Y to 24K and the photosensitive drums 22Y to 22K are generically referred to as the laser beam source 24 and the photosensitive drum 22, respectively, when it is not particularly required to differentiate between the laser beam sources and the photosensitive drums, based on the colors.

The photosensitive drum 22 is formed by coating the outer periphery of an aluminum cylinder with an organic light conductive layer, and is configured to perform rotation when a driving force is transmitted from a drive motor (not shown). The drive motor causes counterclockwise rotation of the photosensitive drum according to image forming operation.

An electrostatic latent image formed on the photosensitive drum 22 is visualized as a toner image by an associated one of developing devices 26. The developing devices 26, i.e. four developing devices 26Y, 26M, 26C, and 26K for developing yellow (Y), magenta (M), cyan (C), and black (K) toner images are provided at respective stations. The developing devices 26Y, 26M, 26C, and 26K are provided with respective sleeves 26YS, 26MS, 26CS, and 26KS.

The toner images formed on the respective photosensitive drums 22 are transferred onto the intermediate transfer belt 27. The intermediate transfer belt 27 rotates clockwise in synchronism with rotation of each of the photosensitive drums 22Y, 22M, 22C, and 22K. The intermediate transfer belt 27 is held in contact with the photosensitive drums 22Y, 22M, 22C, and 22K, and the toner images formed on the photosensitive drums 22Y, 22M, 22C, and 22K are primarily transferred onto the intermediate transfer belt 27 at the respective contact positions.

In the present embodiment, the intermediate transfer belt 27 is implemented by a single-layer polyimide resin belt having a circumferential length of 895 mm. Further, carbon particulates in an appropriate amount are dispersed in the resin for adjustment of belt resistance. For this reason, the intermediate transfer belt 27 has a black surface with high smoothness and glossiness. The rotational speed of the intermediate transfer belt 27 is set to 246 mm/sec which the same as process speed.

The toner image carried on the intermediate transfer belt 27 is transferred by a transfer unit 28 onto a recording material 21, i.e. a sheet conveyed from a sheet feeder 11. More specifically, the multicolor toner image on the intermediate transfer belt 27 is transferred onto the recording material 21 being conveyed forward in a state nipped between the intermediate transfer belt 27 and a roller of the transfer unit 28. The toner image transferred onto the recording material 21 is heated and fixed by a heating roller 31 and a pressure roller 32 in a fixing unit 30. The recording material 21 having the toner image fixed thereon is conveyed from the fixing unit 30 and is detected by a sheet discharge sensor 42, followed by being discharged.

Next, a description will be given of density images (hereinafter referred to as "toner patches P") formed for density correction and an optical sensor 41 (hereinafter simply referred to as "the sensor 41"). The sensor 41 (photo detector unit) is disposed in facing relation to the intermediate transfer belt 27 to detect the surface conditions of the intermediate transfer belt 27 and the toner patches P.

Figure 2:
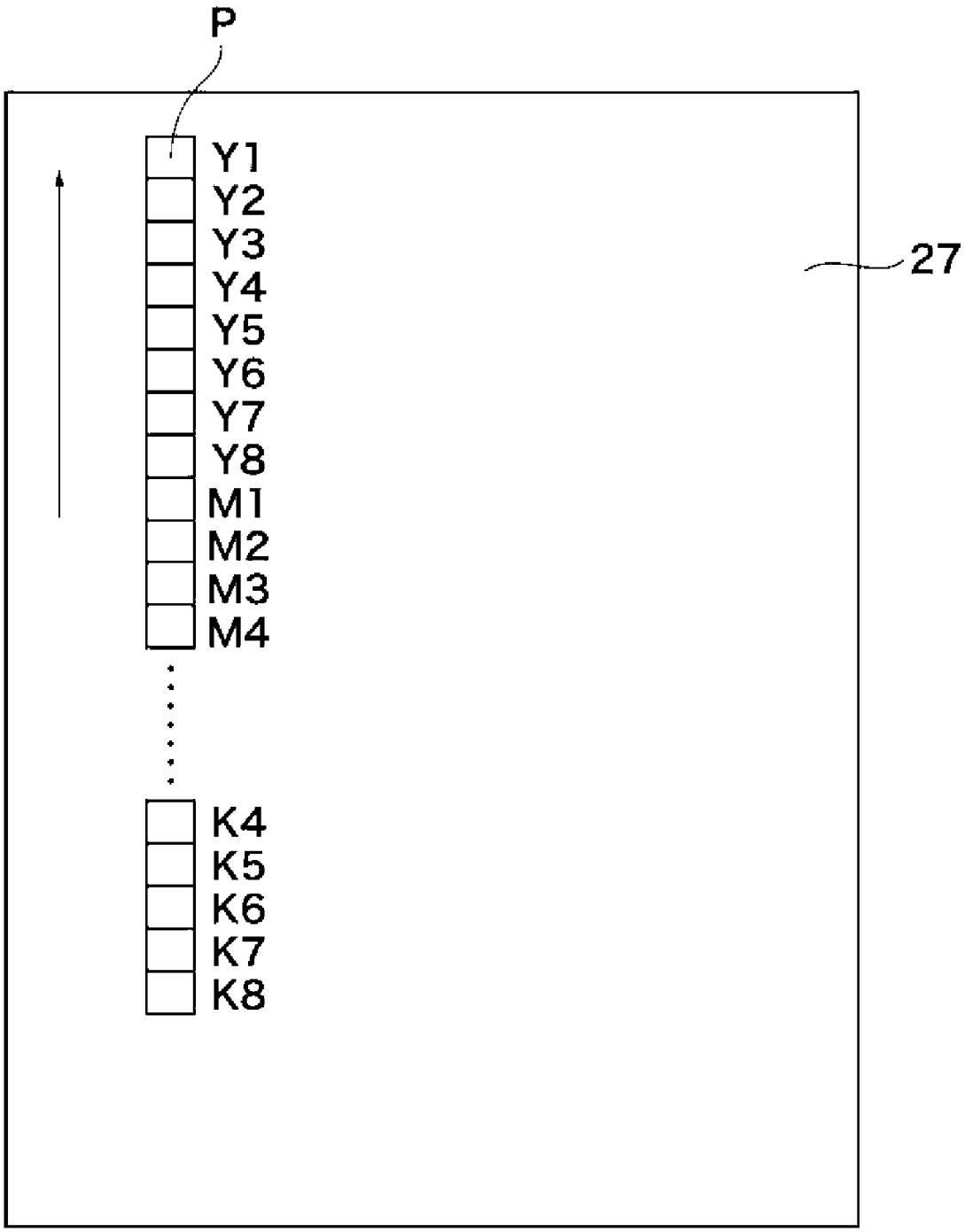
FIG. 2 is a view of toner patches formed on an intermediate transfer belt.
Figure 3:
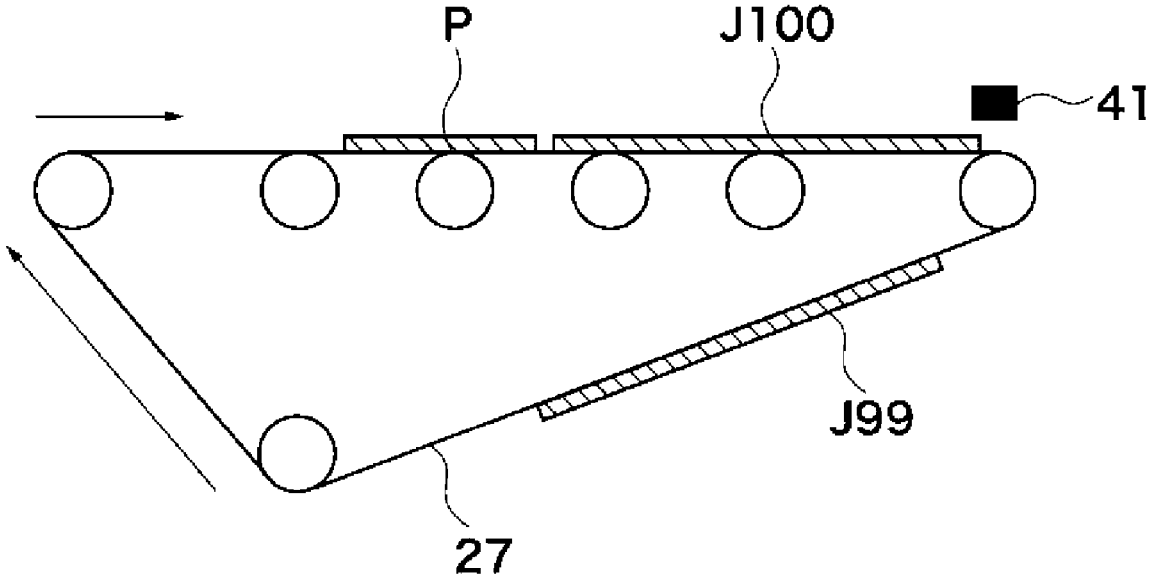
FIG. 3 is a view of the intermediate transfer belt having the toner patches and page images formed thereon.

FIG. 2 is a view of the toner patches P formed on the intermediate transfer belt 27. FIG. 3 is a view of the intermediate transfer belt 27 having the toner patches P and page images formed thereon. The toner patches P are formed on an image carrier, such as a photosensitive drum or an intermediate transfer belt. In the present embodiment, the toner patches P (detection toner images) are formed on the intermediate transfer belt 27.

An arrow in FIG. 2 shows the direction of rotation of the intermediate transfer belt 27. Each toner patch P has a 25 mm-square shape, and thirty-two toner patches P in total are formed on the intermediate transfer belt in a manner arranged in the direction of rotation (circumferential direction) such that eight patches having eight different image printing ratios (density gradations), respectively, are provided for each color of Y, M, C, and K.

The relationship between each toner patch and the printing ratio (density gradation) is set as follows:

Y1, M1, C1, K1=12.5%
Y2, M2, C2, K2=25%
Y3, M3, C3, K3=37.5%
Y4, M4, C4, K4=50%
Y5, M5, C5, K5=62.5%
Y6, M6, C6, K6=75%
Y7, M7, C7, K7=87.5%
Y8, M8, C8, K8=100%

In the present embodiment, the toner patches P are formed rearward of a 100-th page image J100 and detected by the sensor 41. The sensor 41 is disposed downstream of a primary transfer section (see FIG. 1) so as to detect the surface conditions of the intermediate transfer belt 27 and the toner patches P formed on the intermediate transfer belt 27.

Figure 4:
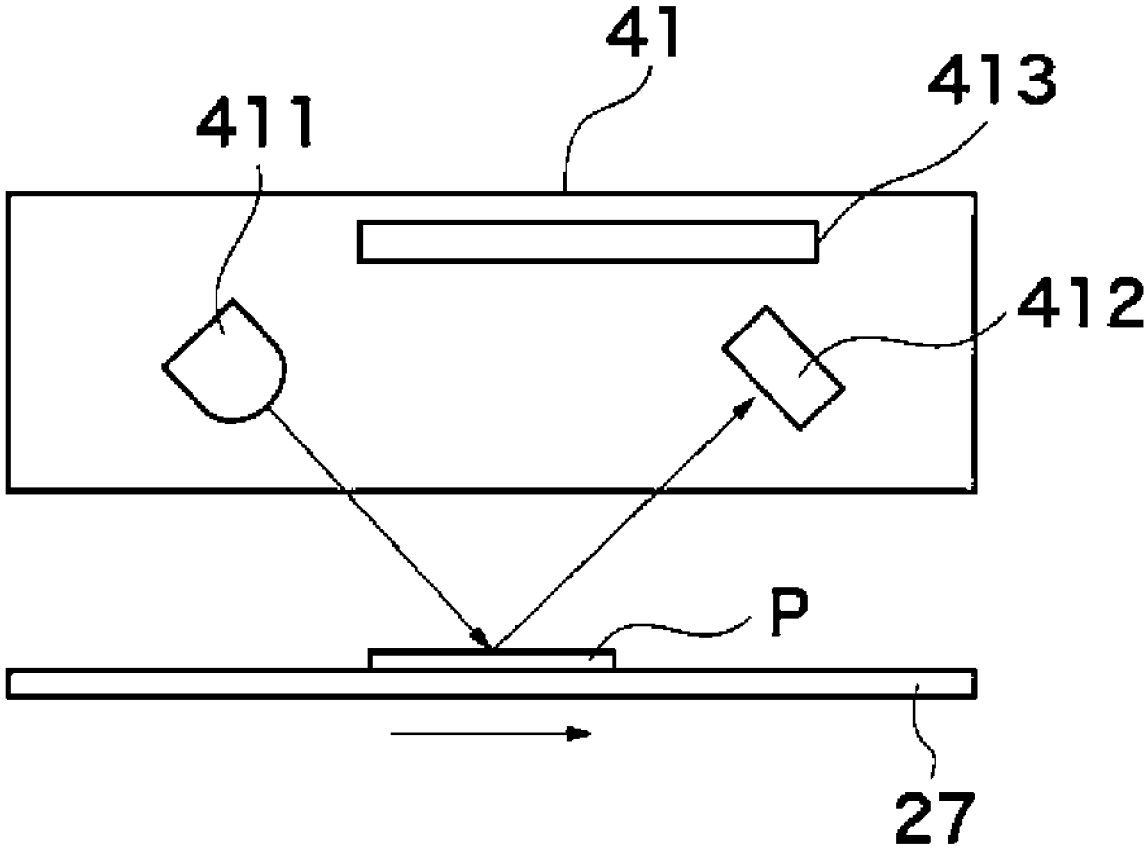
FIG. 4 is a view showing the arrangement of a sensor.

FIG. 4 is a view showing the arrangement of the sensor 41. The sensor 41 is comprised of a light emitter 411 implemented e.g. by an LED, a light receiver 412 implemented e.g. by a photodiode, and an IC 413 that controls the amount of light to be emitted by the light emitter 411.

The light emitter 411 is disposed at an angle of 45 degrees with respect to a normal to the intermediate transfer belt 27, for emitting light to the intermediate transfer belt 27. The light receiver 412 is disposed at a location symmetrical to the light emitter 411 with respect to the normal to the intermediate transfer belt 27, for receiving specular reflection light from the toner patches P. FIG. 4 shows a toner patch P passing a detection area for the sensor 41.

Figure 5:
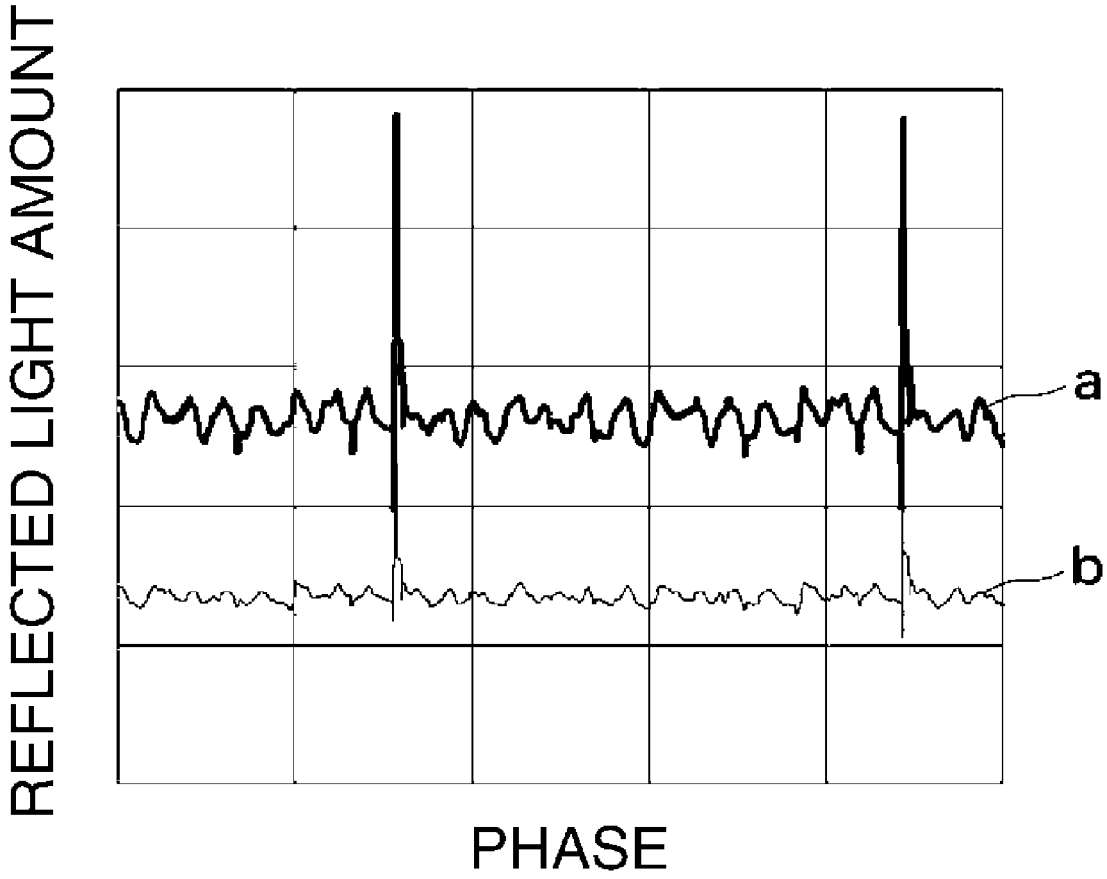
FIG. 5 is a graph showing reflected light amount distributions each corresponding to one rotation of the intermediate transfer belt, between which the amount of emitted light is changed.

The IC 413 controls the amount of light emitted by the light emitter 411, by adjusting a voltage applied to the light emitter 411 of the sensor 41. FIG. 5 is a graph showing reflected light amount distributions each corresponding to one rotation of the intermediate transfer belt, between which the amount of emitted light is changed. In the graph, the horizontal axis represents the circumferential location (phase) of the intermediate transfer belt, while the vertical axis represents the amount of reflected light. Further, a bold solid line "a" indicates a case where the amount of reflected light is large, while a thin solid line "b" indicates a case where the amount of reflected light is small. As shown in FIG. 5, when the amount of light emitted differs, the amount of reflected light from the same object also differs. More specifically, the stronger the emitted light, the larger the amount of reflected light from the object is.

The IC 413 causes the sensor 41 to operate at two light amount levels. One of the two light amount levels is set as a level suitable for detection of toner patch density. The other is set as a level suitable for pattern matching, described hereinafter.

Figure 6:
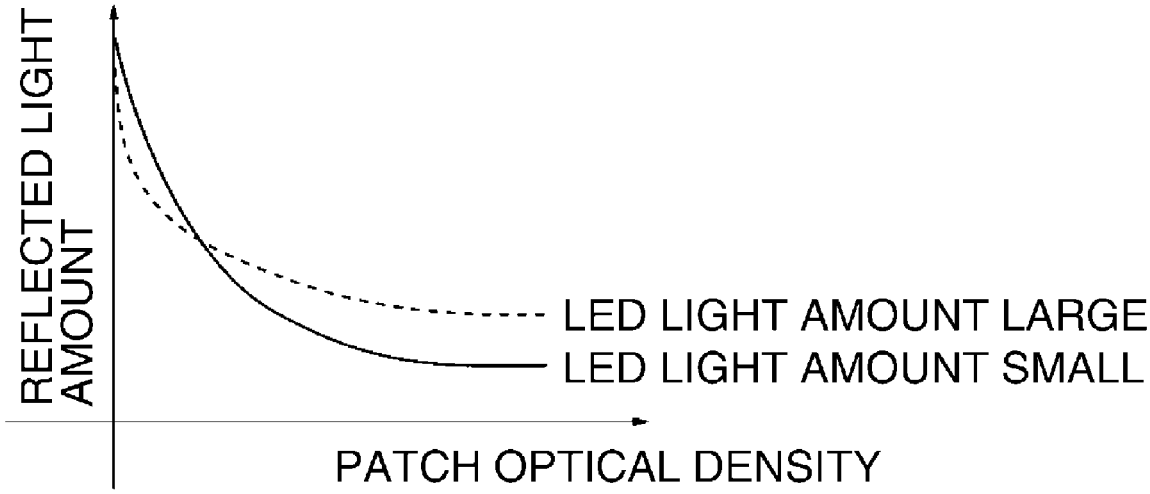
FIG. 6 is a graph showing the relationship between toner patch density and the amount of reflected light.

The level suitable for detection of toner patch density can be explained as follows: FIG. 6 is a graph showing the relationship between the toner patch density and the reflected light amount. As shown in FIG. 6, high-density toner patches tend to be less responsive in respect of the reflected light amount therefrom to a change in toner patch density as the light amount is larger. On the other hand, low-density toner patches tend to be progressively lower in the absolute value of the amount of reflected light therefrom, as the light amount is smaller, which makes it difficult to distinguish the reflected light from uneven gloss of the background surface. The term "high density" in the present embodiment is intended to mean a density which is not lower than an optical density of 1.0.

Therefore, it is desirable that a light amount level is maintained, as the appropriate light amount level for detection of toner patch density, at a level which makes it possible to distinguish the amount of reflected light from a low-density toner patch from uneven gloss of the background surface and at which the amount of reflected light from a high-density toner patch is highly responsive to a change in toner patch density.

In the present embodiment, a light amount level is adopted at which an average reflected light amount from the background surface corresponding to one rotation of the intermediate transfer belt is equal to 3.5 [V]±0.1 [V]. Hereafter, this light amount level will be referred to as "the patch-detecting light amount level".

On the other hand, the appropriate level for pattern matching can be defined as a light amount level which maximizes a rise or fall in the value of the reflected light amount from the background surface. In a case where pattern matching, described hereinafter, is performed between the amount of reflected light from a portion of the background surface and the amount of reflected light from the background surface corresponding to one rotation of the intermediate transfer belt, accuracy in pattern matching is improved when the rise or fall in the value of the reflected light amount is larger.

FIG. 5 shows a reflected light amount distribution in a case where the rise or fall in the value of the reflected light amount is large and one in a case where the rise or fall in the value is small. As shown in FIG. 5, when the reflected light amount is small (i.e. in a case indicated by "b"), the rise or fall in the value is also small, whereas when the reflected light amount is large (i.e. in a case indicated by "a"), the rise or fall in the value is also large. In the present embodiment, a light amount level is adopted at which an average reflected light amount from the background surface corresponding to one rotation of the intermediate transfer belt is equal to 4.5 [V]±0.1 [V]. Hereafter, this light amount level will be referred to as "the pattern-matching light amount level".

Although in the present embodiment, the amount of light emitted from the light emitter 411 is adjusted to thereby obtain the appropriate reflected light amount for pattern matching, some other method may be employed to obtain the appropriate reflected light amount for pattern matching. More specifically, it is possible to employ a method in which the output gain of the light receiver 412 is adjusted using a variable resistor or a method in which both the output gain of the light emitter 411 and that of the light receiver 412 are adjusted.

Figure 7:
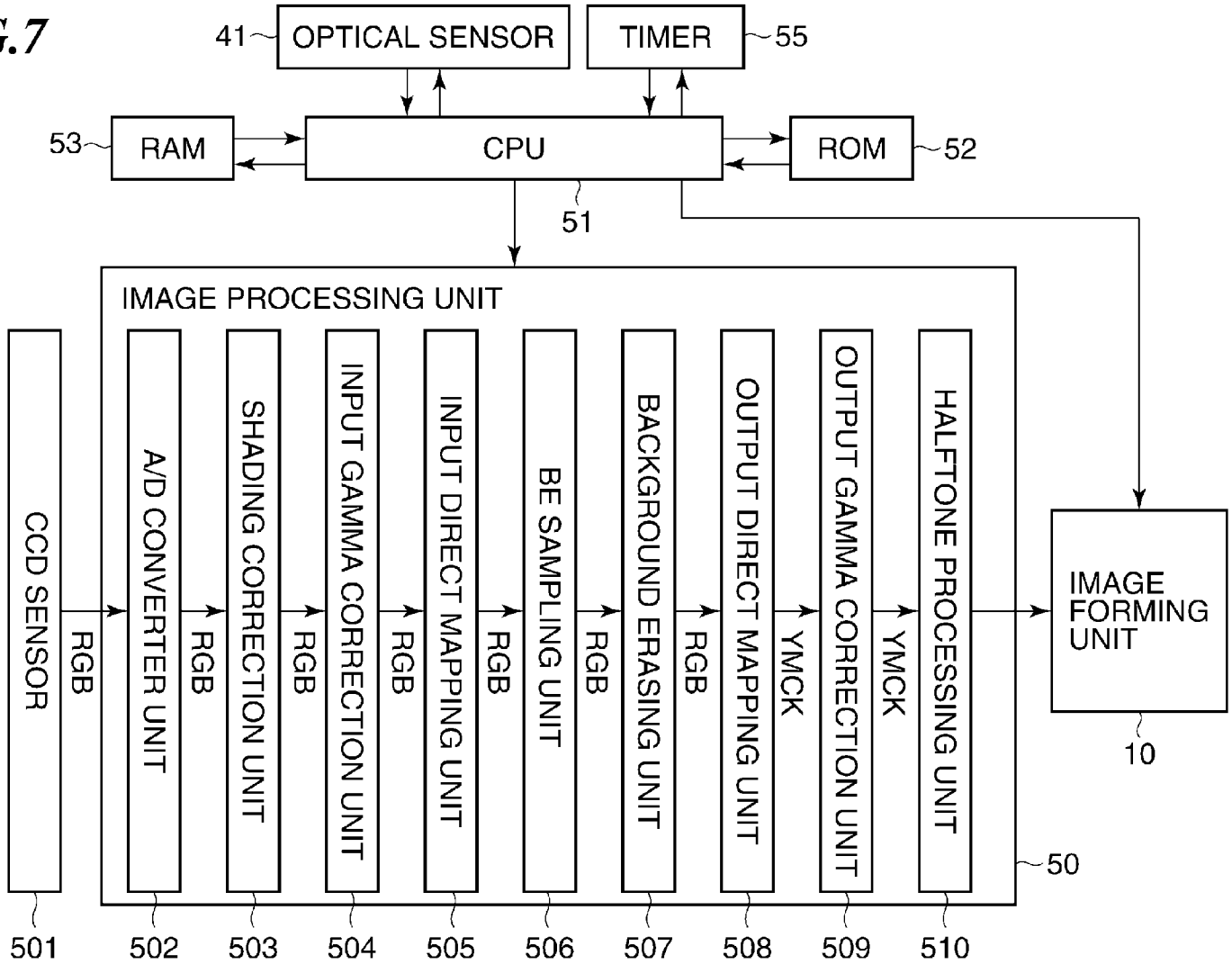
FIG. 7 is a block diagram of an image processing unit of the image forming apparatus.

FIG. 7 is a block diagram of an image processing unit 50 of the image forming apparatus. A CPU 51 performs centralized overall control of component elements of the image processing apparatus based on control programs stored in a ROM 52, using a RAM 53 as a work memory.

Figures 8A, 8B:
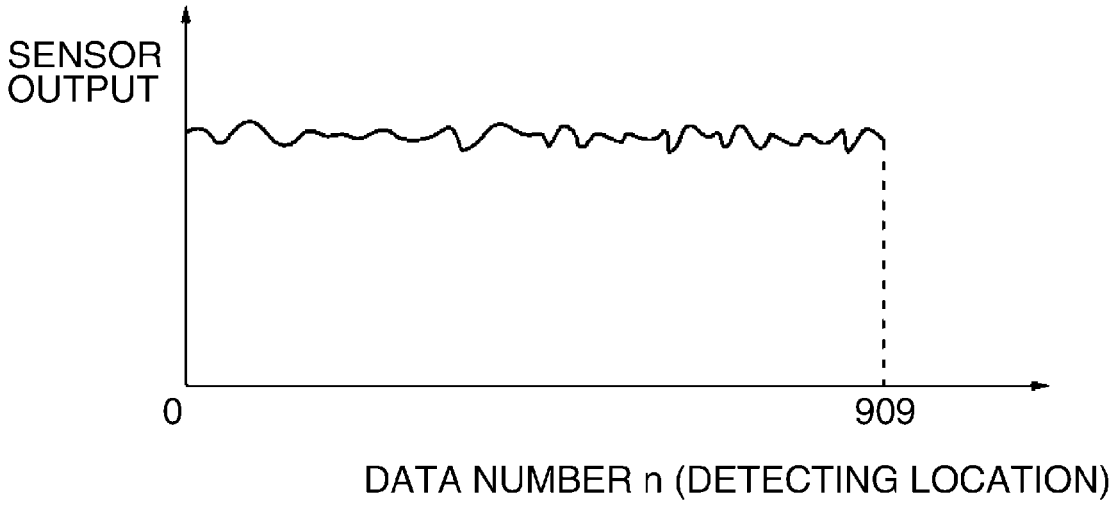
FIG. 8A is a diagram showing a table of a one-rotation background profile.
FIG. 8B is a graph of the one-rotation background profile.

The RAM 53 stores a one-rotation background profile representing reflected light from the surface of the background of the toner patches P corresponding to the one rotation of the intermediate transfer belt, which is read by the sensor 41. FIGS. 8A and 8B are diagrams of the one-rotation background profile. FIG. 8A is a diagram showing a table of a one-rotation background profile and FIG. 8B is a graph showing the one-rotation background profile. The vertical axis of this graph represents the sensor output of the sensor 41, and the horizontal axis represents a detecting location (data number n) on the background.

In the present embodiment, immediately after the power of the printer is turned on, the intermediate transfer belt 27 rotates with no toner carried thereon. At this time, the sensor 41 reads the surface of the rotating intermediate transfer belt 27 corresponding to one rotation of the intermediate transfer belt. Specular reflection light output (sensor output) obtained by the scanning is stored as the one-rotation background profile (hereinafter simply referred to as "the one-rotation profile").

It should be noted that two kinds of one-rotation profiles are stored. One of them is a first one-rotation profile obtained by controlling the sensor 41 at the aforementioned patch-detecting light amount level and stored in the RAM 53, and the other is a second one-rotation profile obtained by controlling the sensor 41 at the aforementioned pattern-matching light amount level and stored in the RAM 53.

During the first rotation of the intermediate transfer belt 27, the sensor 41 is controlled to operate at the patch-detecting light amount level, and the first one-rotation profile is stored. During the second rotation of the intermediate transfer belt 27, the sensor 41 is controlled to operate at the pattern-matching light amount level, and the second one-rotation profile is stored.

Figure 9:
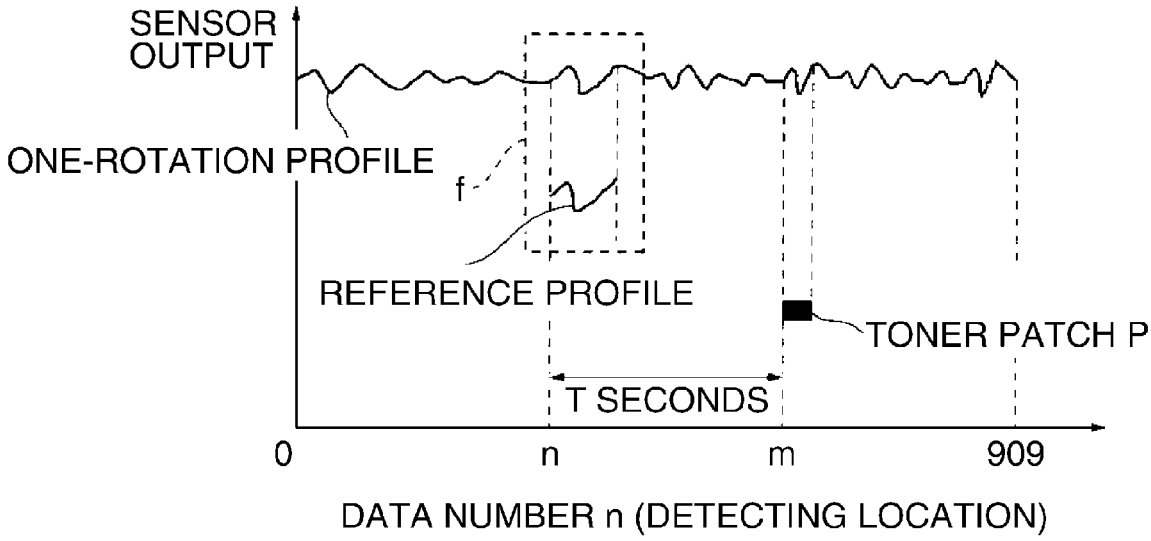
FIG. 9 is a graph showing specular reflection light output obtained during a time period from the start of reading of a partial background profile to the start of reading of the toner patches.

FIG. 9 is a graph showing specular reflection light output obtained during a time period from the start of reading of a partial background profile until after the reading of a toner patch P. In the graph, the vertical axis represents sensor output from the sensor 41, and the horizontal axis represents the data number n.

As shown in FIG. 9, a timer 55 measures a time period Tsec from the start of reading of the partial background profile to the start of reading of the toner patch P. This operation will be described in detail hereinafter.

The CPU 51 calculates a density DENS(i) of a toner patch P using specular reflection light output P(i) from the toner patch P (hereinafter referred to as "the toner patch reflection light output P(i)") and specular reflection light output R(i) from a portion of the intermediate transfer belt 27 immediately under the toner patch P (hereinafter referred to as "the toner patch background reflection light output R(i)"), which is obtained during detection of the surface conditions of the intermediate transfer belt 27.

Further, the CPU 51 causes the sensor 41 to read an exposed portion of the surface of the intermediate transfer belt 27 between two images of respective pages (page images) formed in succession before formation of toner patches P. Specular reflection light output (sensor output) obtained by the reading is stored as a partial background profile (hereinafter referred to as "the reference profile"). At this time, the sensor 41 is being controlled to operate at the aforementioned pattern-matching light amount level.

The CPU 51 performs pattern matching between the reference profile obtained by the reading and the second one-rotation profile to thereby identify a portion of the second one-rotation profile which matches with the reference profile, or an output portion closely analogous to the reference profile (see a frame f enclosed by dotted lines in FIG. 9). It should be noted that the sensor output level of the reference profile is equal to that of the second one-rotation profile, but in the graph in FIG. 9, these patterns are distinguishably illustrated for ease of understanding.

The CPU 51 determines the toner patch background reflection light output R(i) at the time of forming the toner patch P, based on the positional relationship on the intermediate transfer belt 27 between the identified portion and a location at which the toner patch P is formed.

The CPU 51 detects the density of the toner patch P and generates correction data based on the detected density.

As described above, the density of the toner patch P is calculated based on the toner patch reflection light output (reflected light amount) P(i) and the toner patch background reflection light output (reflected light amount) R(i). Further, correction data is generated based on the calculated density. This process will be described in detail hereinafter. Then, the generated correction data is transmitted to the image processing unit 50, described below, by a toner patch density transmission section incorporated in the CPU 51.

Next, a description will be given of the operation of the image processing unit 50 that processes images read by a document reader. A CCD sensor 501 is provided in the document reader implemented e.g. by a scanner as an image reading device, and converts a read original image to electric signals. The CCD sensor 501 is an RGB 3-line color sensor. Image signals of R (red), G (green), and B (blue) colors output from the CCD sensor 501 are input to an A/D converter unit 502.

The A/D converter unit 502 performs gain adjustment and offset adjustment of the image signals, and then converts the image signals to digital image data of 8 bits on a color signal-by-color signal basis. A shading correction unit 503 corrects variation in the sensitivity of each pixel of the CCD sensor 501, variation in the amount of light from an original-illuminating lamp, and so forth, on a color-by-color basis, using a read signal generated by reading a reference white board.

An input gamma correction unit 504 is a one-dimensional lookup table (LUT) that corrects each of input R, G, and B image data items such that the exposure amount of each color and luminance thereof satisfy a linear relationship.

An input direct mapping unit 505 is a three-dimensional LUT that converts the input RGB signals to in-device RGB signals so as to form a unified color space. The three-dimensional LUT is provided to convert a reading color space determined by the spectral characteristics of the R, G, and B filters of the CCD sensor 501 to a standard color space, such as an sRGB (standard RGB), and is also capable of accommodating characteristics, such as the sensitivity characteristics of the CCD sensor 501 and the spectral characteristics of the illuminating lamp.

A BE (Background Erase) sampling unit 506 discretely samples pixels in a designated rectangular area so as to detect a background of an original, and forms a histogram of the luminance of the pixels. This histogram is used to erase the background during print processing.

A background erasing unit 507 performs nonlinear conversion for erasing a background portion on the RGB image data read by the scanner, based on the results of sampling performed by the BE sampling unit 506. Then, the RGB image data is converted to CMYK image data by an output direct mapping unit 508. To perform this conversion, the output direct mapping unit 508 inputs the values of the respective RGB colors to a lookup table, and generates a C (cyan) component based on the total sum of the output values from the lookup table. Similarly, the output direct mapping unit 508 generates the respective components of M (magenta), Y (yellow), and K (black) using lookup tables and performing addition operations of the output values from the lookup tables.

An output gamma correction unit 509 performs density correction such that an output image becomes compatible with the printer. The output gamma correction unit 509 plays the role of maintaining linearity of output image data, which varies with every image formation, based on a one-dimensional lookup table of CMYK stored in advance.

The optical sensor 41 associated with density detection, the RAM 53, and the CPU 51 creates the one-dimensional lookup table of CMYK. The one-dimensional lookup table of CMYK is updated in timing in which the toner patch density transmission section sends a one-dimensional LUT created anew to the output gamma correction unit 509. It should be noted that a process executed by the CPU 51 will be described in detail hereinafter with reference to a flowchart.

A halftone processing unit 510 can selectively apply a different type of screening according to a function of the apparatus. In general, the halftone processing unit 510 uses an error-diffusion type screening which can suppress moire, for a copying operation, and a multi-valued screen type screening using a dither matrix because of excellent reproducibility of text data and thin lines, for a printing operation.

The former screening is a method which assigns weights to a target pixel and peripheral pixels using error filters, to thereby distribute multivalue conversion errors while maintaining the number of gradations, for correction of the errors. On the other hand, the latter is a method which sets multi-valued thresholds of a dither matrix to thereby express pseudo intermediate gradations. In the present embodiment, conversion is performed independently for each of CMYKG, while switching between a small line number (low dot density) and a large line number (high dot density) according to input image data, for reproduction.

Now, a description will be given of a toner patch density correcting method executed by the image forming apparatus of the present embodiment. The toner patch density correcting method is executed following steps (a) to (d) described below.

(a) The CPU 51 causes the sensor 41 to detect the intermediate transfer belt 27 during one rotation of the intermediate transfer belt after the power is turned on. Further, immediately before the number of printed sheets reaches a predetermined number, the CPU 51 causes the sensor 41 to detect a portion of the intermediate transfer belt 27 between two page images printed in succession, while controlling the sensor 41 at the pattern matching LED light amount level.

Then, after the predetermined number of sheets are printing operated, the CPU 51 causes toner patches P to be formed on the intermediate transfer belt 27, and then causes the sensor 41 to detect the toner patches P while controlling the sensor 41 at the patch detection LED light amount level.

(b) The CPU 51 identifies a reflection light output from each of desired portions of the intermediate transfer belt 27 based on the results of the above-mentioned two types of detection by the sensor 41. In the present embodiment, the CPU 51 sets the desired portion as a location where a toner patch P is formed, and identifies the toner patch background reflection light output R(i).

(c) The CPU 51 calculates the density of each toner patch P, using the toner patch reflection light output P(i) and the toner patch background reflection light output R(i).

(d) The CPU 51 generates correction conditions based on the calculated toner patch P density, and corrects input image data according to the correction conditions.

These steps (a) to (d) will be described in detail. First, in the step (a), the CPU 51 causes the intermediate transfer belt 27 to perform one rotation with no toner patch P formed thereon, and causes the sensor 41 to read the surface conditions of the intermediate transfer belt 27 corresponding to one rotation of the same, so as to obtain the one-rotation profile of the intermediate transfer belt 27.

The CPU 51 stores data obtained from the sensor 41 at this time in the RAM 53, as the aforementioned second one-rotation profile of the intermediate transfer belt 27. In the image forming apparatus of the present embodiment, the rotational speed of the intermediate transfer belt 27 is set to 246 mm/sec, the circumferential length to 895 mm, and the detection interval of the sensor 41 to 4 msec (the number of times of detection per unit time is set to 250 times/sec). Therefore, 910 data items are obtained from the sensor 41 as shown by the following equation (1):

$$895(\text{mm}) \div 246(\text{mm/sec}) \div (4/1000(\text{sec})) \approx 910 \quad (1)$$

More specifically, as shown in FIGS. 8A and 8B, the one-rotation profile is formed by a continuous sequence of 910 data items. The horizontal axis in FIG. 8B represents data numbers n associated with the respective data items. As described hereinbefore, the two kinds of one-rotation profiles are stored. One of them is the first one-rotation profile obtained by controlling the sensor 41 at the patch-detecting light amount level and stored in the RAM 53, and the other is the second one-rotation profile obtained by controlling the sensor 41 at the pattern-matching light amount level and stored in the RAM 53.

During the first rotation of the intermediate transfer belt 27, the sensor 41 is controlled to operate at the patch-detecting light amount level, and data from the sensor 41 is stored as the first one-rotation profile. During the second rotation of the intermediate transfer belt 27, the sensor 41 is controlled to operate at the pattern-matching light amount level, and data from the sensor 41 is stored as the second one-rotation profile.

Next, a description will be given of the reference profile of a portion of the intermediate transfer belt 27. In order to obtain the reference profile, the CPU 51 causes the sensor 41 to read the surface conditions of the portion of the intermediate transfer belt 27 and then causes the RAM 53 to store the reflection light output from the sensor 41. At this time, the sensor 41 is being controlled to operate at the above-mentioned pattern matching LED light amount level.

The CPU 51 causes the sensor 41 to detect an area, where no toner image is formed, between an image formed on a first recording sheet and another image formed on a second recording sheet, or an non-image-forming area, such as between sheets, so as to obtain the reference profile. In a case where continuous printing is performed, space exists in a portion of the intermediate transfer belt 27 corresponding to the area between the first recording sheet and the second recording sheet succeeding the first recording sheet. No image is formed in this space, and hence the surface of the intermediate transfer belt 27 is exposed. The sensor 41 reads reflected light from the space (specific portion) between the page images (toner images).

Figures 10A, 10B:
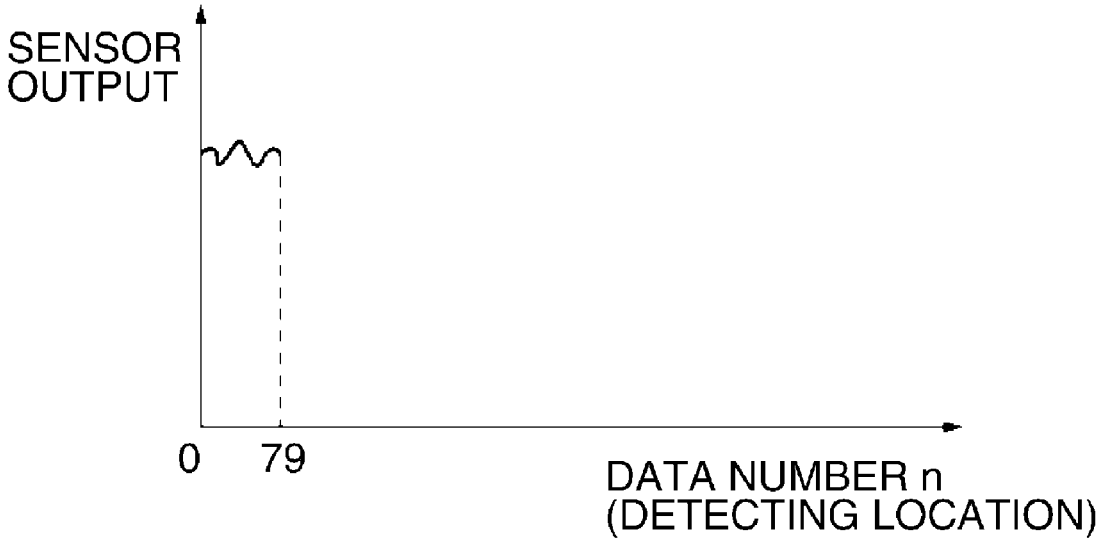
FIG. 10A is a diagram showing a table of a reference profile.
FIG. 10B is a graph of the reference profile.

In the illustrated example, the sensor 41 irradiates light onto a portion of the intermediate transfer belt 27 between a page image J99 for a 99th sheet and a page image J100 for a 100th page to thereby detect reflected light from the portion of the intermediate transfer belt 27. FIGS. 10A and 10B are diagrams showing the reference profile, in which FIG. 10A is a table of the reference profile, and FIG. 10B is a graph thereof. The vertical axis of the graph represents the sensor output from the sensor 41, and the horizontal axis represents the detecting location (data number n) on the background. The graph in FIG. 10B shows distribution of the reflection light output (sensor output) from the sensor 41, which is generated according to the reflected light from the intermediate transfer belt 27.

In the present embodiment, it is assumed that a minimum length between sheets in the image forming apparatus is set to 79 mm. The rotational speed of the intermediate transfer belt 27 is set to 246 mm/sec, and the detection interval of the sensor 41 to 4 msec. Therefore, eighty data items are obtained from the sensor 41 as shown by the following equation (2):

$$79(\text{mm}) \div 246(\text{mm/sec}) \div (4/1000(\text{sec})) \approx 80 \quad (2)$$

More specifically, the reference profile is formed by a continuous sequence of at least eighty data items. Detection for the second one-rotation profile and detection for the reference profile are performed by the same sensor 41, which means that the two profiles are obtained through detection of the same line in the direction of rotation of the intermediate transfer belt 27.

For this reason, unless the conditions of the intermediate transfer belt 27 are changed e.g. by being scratched during a time period from detection of the second one-rotation profile to detection of the reference profile, the second one-rotation profile includes a data group matching with or closely analogous to the reference profile.

In the image forming apparatus of the present embodiment, the CPU 51 performs pattern matching between the second one-rotation profile and the reference profile so as to identify a correspondence between the two data groups.

Next, a description will be given of a method executed in the step (b) for identifying the toner patch background reflection light output R(i) based on the results of detection by the sensor 41. As described hereinabove, in the image forming apparatus of the present embodiment, the CPU 51 performs pattern matching between the second one-rotation profile and the reference profile to thereby identify a data group included in the second one-rotation profile and matching with the reference profile.

Further, based on the positional relationship on the intermediate transfer belt 27 between the identified data group and a location where the toner patch P is formed, and the first one-rotation profile, the CPU 51 identifies the toner patch background reflection light output R(i). This method will be described in detail.

The pattern matching is performed by determining a correlation function between the second one-rotation profile and the reference profile.

As for correlation between discrete data groups Xi and Yi, as the value of a correlation coefficient S(i) between the two data groups is closer to a value of 1, the correlation between Xi and Yi is higher, and the similarity therebetween is also higher. The correlation coefficient S(i) between the two discrete data groups Xi and Yi (i=0 to N−1) each consisting of N data items can be obtained by the following equation (3):

$$S = \frac{\sum_{i=0}^{N-1}(Xi - Xave)(Yi - Yave)}{\sqrt{\sum_{i=0}^{N-1}(Xi - Xave)^2}\sqrt{\sum_{i=0}^{N-1}(Yi - Yave)^2}} \quad (3)$$

In the present embodiment, Xi represents each of a continuous sequence of eighty data items extracted from the second one-rotation profile formed by 910 data items. Xave represents an average value of the extracted eighty data items. Yi represents each of a continuous sequence of eighty data items forming the reference profile. Yave represents an average value of these eighty data items.

More specifically, when the data group forming the second one-rotation profile is formed by the data items X(i) (i=0 to 909), the CPU 51 extracts a data group formed by a continuous sequence of eighty data items (e.g. data items X(0) to X(79)) from the 910 data items X(i).

A correlation coefficient S(0) is calculated by the following equation (4), based on a data group Y(j) (j=0 to 79) forming the reference profile and the data group X(i) (i=0 to 79) extracted from the second one-rotation profile:

$$S(0) = \frac{\sum_{i=0}^{79}\sum_{j=0}^{79}(X(i) - Xave)(Y(j) - Yave)}{\sqrt{\sum_{i=0}^{79}(X(i) - Xave)^2}\sqrt{\sum_{j=0}^{79}(Y(j) - Yave)^2}} \quad (4)$$

Similarly, function coefficients S(i) (i=0 to 909) between each of the data groups forming the second one-rotation profile and the reference profile are calculated by the following equations (5) to (7):

$$S(1) = \frac{\sum_{i=1}^{80}\sum_{j=0}^{79}(X(i) - Xave)(Y(j) - Yave)}{\sqrt{\sum_{i=1}^{80}(X(i) - Xave)^2}\sqrt{\sum_{j=0}^{79}(Y(j) - Yave)^2}} \quad (5)$$

$$S(2) = \frac{\sum_{i=2}^{81}\sum_{j=0}^{79}(X(i) - Xave)(Y(j) - Yave)}{\sqrt{\sum_{i=2}^{81}(X(i) - Xave)^2}\sqrt{\sum_{j=0}^{79}(Y(j) - Yave)^2}} \quad (6)$$

$$S(910) = \frac{\sum_{i=910}^{910+79}\sum_{j=0}^{79}(X(i) - Xave)(Y(j) - Yave)}{\sqrt{\sum_{i=910}^{910+79}(X(i) - Xave)^2}\sqrt{\sum_{j=0}^{79}(Y(j) - Yave)^2}} \quad (7)$$

The intermediate transfer belt 27 is an endless belt, and therefore in the case of calculating the function coefficients S(832) to S(910), some of the eighty data items extracted from the data group X(i) are repetitions from the start of the data group X(i). For example, a data group extracted so as to obtain the function coefficient S(831) is formed a total of eighty data items consisting of seventy-nine data items X(831) to X(909) and X(0). Further, a data group extracted so as to obtain the function coefficient S(909) is a total of eighty data items consisting of seventy-nine data items X(909) and X(0) to X(78). It should be noted that as for an expression "910+79" in the equation (7), X(910) corresponds to X(0), X(911) corresponds to X(1), and X(988) corresponds to X(78).

As described hereinbefore, as the value of the correlation coefficient S(i) is closer to the value of 1, the correlation between Xi and Yj is higher, and the similarity therebetween is also higher. In this case, that the similarity is high means that there is a substantial match between the pattern of a data group extracted from the second one-rotation profile and that of the reference profile.

The image forming apparatus of the present embodiment determines that a data group extracted from the second one-rotation profile and having a correlation function S(i) closer to 1 than any other correlation function S(i) (i=0 to 909) has a highest similarity to the reference profile. In short, the CPU 51 determines that the data group extracted from the second one-rotation profile and having a correlation function S(i) closest to 1 is identical in location to the reference profile.

Thus, the CPU 51 sets the location of the portion of the second one-rotation profile, which has the pattern matching that of the reference profile, as a reference position. The CPU 51 identifies background data based on the positional relationship between the reference position and a location where a toner patch P is formed and the first one-rotation profile.

First, the CPU 51 determines the data number n of a data item corresponding to a start of the reference position. Assuming that this data item is X(n) (0≦n≦909), the data item X(n) corresponds to the leading data item Y(n) of the reference profile. A toner patch P starts to be formed when T seconds have elapsed after detection of the data item Y(n). More specifically, the toner patch P starts to be formed from a location spaced by a predetermined distance from a location where the data item Y(n) is detected. In other words, the toner patch P starts to be formed from a predetermined location (second circumferential location) determined with reference to a location (first circumferential location in the circumferential direction of the intermediate transfer belt) where the data item Y(n) is detected.

FIG. 9 shows a method of identifying a toner patch background reflection light output R(i). The horizontal axis in the FIG. 9 graph represents each data number denoted by n of the data item X(n). The data number n is within a range of 0≦n≦909 as mentioned hereinbefore, and therefore the maximum value of the horizontal axis is 909.

The timer 55 is turned on in synchronism with the start of detection of specular reflection light of the reference profile, and measures a time period before the reading of the toner patch P (see FIG. 9) is to be started. The CPU 51 identifies the toner patch background reflection light output R(i), based on the result of measurement by the timer 55, the number of times of detection per unit time by the sensor 41, and the first one-rotation profile.

For example, it is assumed that the reflection light output from the leading portion of the reference profile is represented by X(n), and reading of the toner patches P is started T seconds after the timer 55 starts the measurement. The image forming apparatus according to the present invention starts acquiring patch data by the sensor 41 when the time measured by the timer 55 becomes equal to T seconds, i.e. slightly before the toner patch P is reached, and recognizes a location corresponding to several samples after a sampling point where the patch data (sensor output) changes across a threshold value, as a leading end of the toner patch P. The leading end of the toner patch P is thus detected based on the patch data detected by the sensor 41 because the toner patch P does not always reach the reading position of the sensor 41 accurately at theoretically expected time due to variations in the rotational speed of the photosensitive drum 22 and the rotational speed of the intermediate transfer belt 27. Now, assuming that the leading reflection light output R(i) from the background of the toner patch P is represented by X(m), since the detection interval of the sensor 41 is set to 4 msec, the number m of times of detection can be expressed by the following equation (8):

$$m=n+1000T/4 \tag{8}$$

Therefore, the leading reflection light output X(m) from the background of the toner patch P can be calculated by the following equation (9):

$$X(m)=X((n+1000T/4)\bmod 910 \tag{9}$$

A general expression of "A mod B" corresponding to a portion in the equation (9) represents the remainder of an integer A divided by an integer B as a modulus (i.e. a remainder obtained by dividing the integer A by the integer B). Since the intermediate transfer belt 27 is an endless belt, as mentioned hereinbefore, a toner patch P can be formed at a location between X(909) and X(0). This possibility is taken into account in the equation (9).

One toner patch P is detected ten times at time intervals of 4 msec. Therefore, the reflection light output from the background of the toner patch P is stored as ten data items X((n+1000T/4)mod 910) to X(((n+1000T/4)mod 910)+9).

Thereafter, the toner patch background reflection light output R(i) formed by the ten data items is used for calculation of the density of the toner patch P.

Then, in the step (c), the CPU 51 calculates the density of the toner patch P using the toner patch reflection light output P(i) and the toner patch background reflection light output R(i). In the present embodiment, the CPU 51 divides the toner patch reflection light output P(i) by the toner patch background reflection light output R(i) to thereby calculate the density of the toner patch P. Specifically, the CPU 51 calculates the toner patch density DENS(i), i.e. the density of a toner patch P by the following equation (10):

$$\mathrm{DENS}(i)=P(i)/R(i) \tag{10}$$

In this equation, R(i) is dependent on the surface conditions of a portion of the intermediate transfer belt 27 immediately under a toner patch P, and hence it can be calculated by the following equation (11):

$$R(i)=X((n+1000T/4)\bmod 910). \tag{11}$$

Therefore, the toner patch density DENS(i) is calculated by the following equation (12):

$$DENS(i)=\frac{P(i)}{X\left(\left(n+\frac{1000T}{4}\right)\bmod 910\right)} \tag{12}$$

In the present embodiment, the sensor 41 detects each toner patch P having the same density ten times, so that the average value of the obtained ten data items is stored as the result of the detection of the toner patch P. The average value of densities DENS(i) to DENS(i+9) is adopted as a final toner patch P density DENS_AVE.

Thus, the CPU 51 calculates the toner density. Since the density of a toner patch P is obtained using the equation (12) while taking into account unevenness in the surface conditions of the intermediate transfer belt 27, it is possible to accurately calculate the toner density by the above-described correction method.

Figure 11:
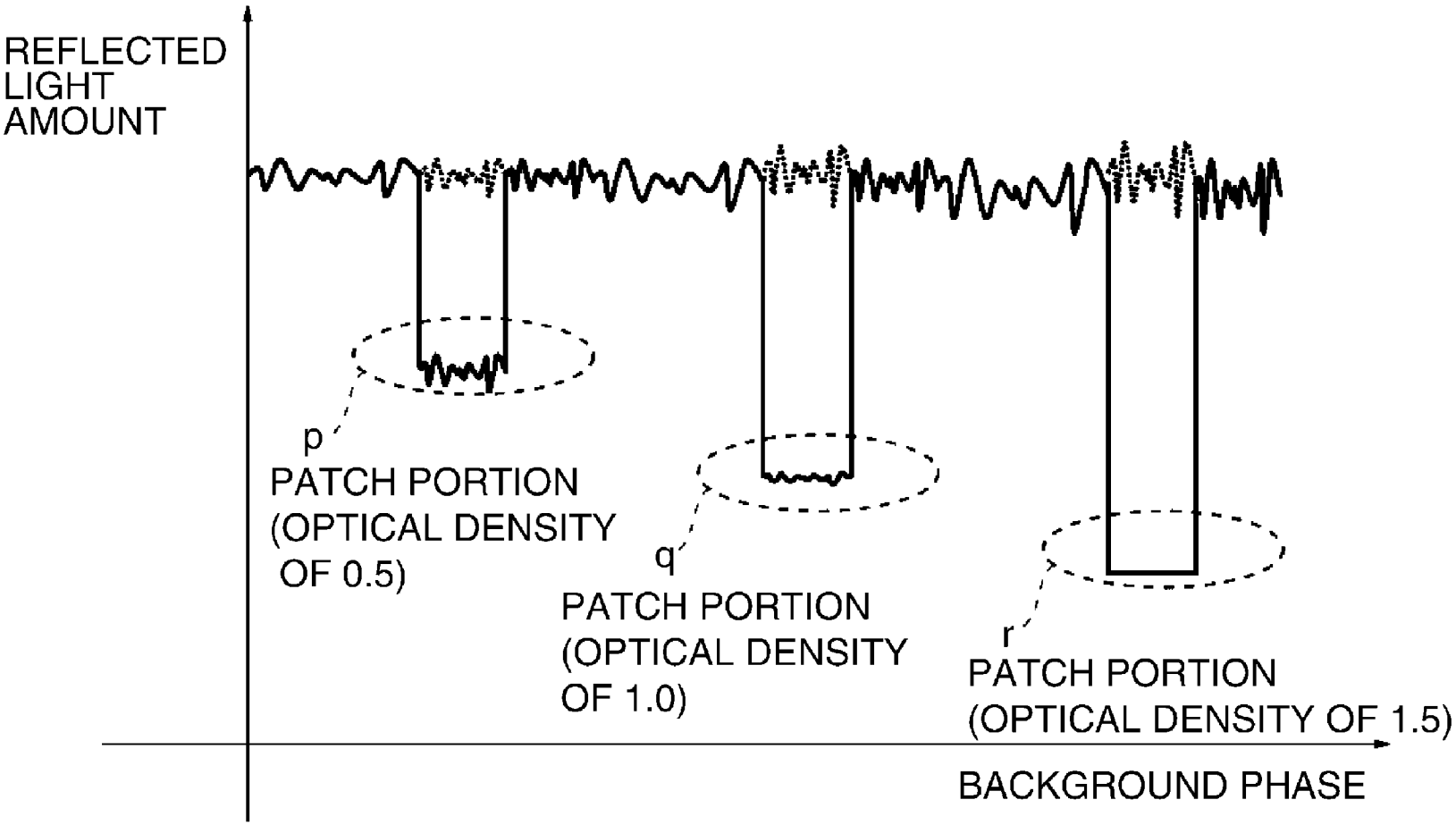
FIG. 11 is a graph showing a reflected light amount distribution corresponding to one rotation of the intermediate transfer belt and a reflected light amount distribution in a state where the intermediate transfer belt has toner patches formed thereon, with their phases aligned.

The degree of influence of unevenness in the surface conditions of the intermediate transfer belt 27 on a toner patch P depends on toner density thereof. FIG. 11 is a graph showing a reflected light amount distribution corresponding to one rotation of the intermediate transfer belt and a reflected light amount distribution in a case where toner patches are placed on the intermediate transfer belt, which are illustrated with the phases of the two distributions aligned with each other. In areas p, q, and r in this graph, there are shown reflected light amount distributions in respective cases where the optical densities of the toner patches P (patch portions) are equal to "0.5", "1.0", and "1.5", respectively.

As is understood from FIG. 11, it can be confirmed that in the low-density patch area (area p), uneven gloss on the surface of the intermediate transfer member is reflected in the toner patch reflected light amount. In the high-density patch area (area r) where toner is dense enough to cover the background, uneven gloss on the surface of the intermediate transfer member is not reflected in the reflected light amount. Thus, in the low-density patch area, the surface of the intermediate transfer member is partially exposed, and hence uneven gloss is reflected in the reflected light amount.

For this reason, in the case of reading a plurality of patches ranging from a low-density patch to a high-density one, it is required to set a threshold value (D_TH) for the toner patch density DENS(i).

It is assumed that an average value of ten densities of a toner patch P obtained using the equation (12) is represented by DENS_AVE. If the average value DENS_AVE is less than the threshold value D_TH, i.e. DENS_AVE≦D_TH, the CPU 51 calculates each of the densities DENS(i) of the toner patch P again, by an equation (13), referred to hereinbelow. More specifically, the CPU 51 calculates each of the toner patch densities DENS(i) again as a reflection light output from the intermediate transfer belt as a background, using a reflection light output R (one-rotation average) as the average of the values of the reflection light output from the intermediate transfer belt detected during one rotation of the intermediate transfer belt. Then, the CPU 51 stores the average value of the ten toner patch densities DENS(i) as the result of detection of the toner patch P.

$$\mathrm{DENS}(i)=P(i)\div R(\text{one-rotation average}) \tag{13}$$

On the other hand, when DENS_AVE>D_TH, the CPU 51 does not calculate each toner patch density DENS(i) again using the equation (13). Thus, in the low-density patch area, it is possible to suppress reflection of uneven gloss on the surface of the intermediate transfer member in the toner patch reflected light amount.

The threshold value D_TH is different depending on a screen which is formed of dots regularly arranged in horizontal and vertical directions, for expressing shades of colors. More specifically, an image signal level which causes the surface of the intermediate transfer member to be partially exposed from a patch is different depending on the screen. In the present embodiment, the threshold value D_TH is set to 0.5.

Next, a description will be given of a method executed in the step (d), in which correction data is generated based on the calculated toner patch density and image data is corrected. The output gamma correction unit 509 corrects the image data using the correction data.

First, a description will be given of the one-dimensional LUT as the correction data updated based on the results of detection of the toner patch densities. Here, only gradation correction of cyan color is described, but correction of each of magenta, yellow, or black is performed by the same method.

Figure 12:
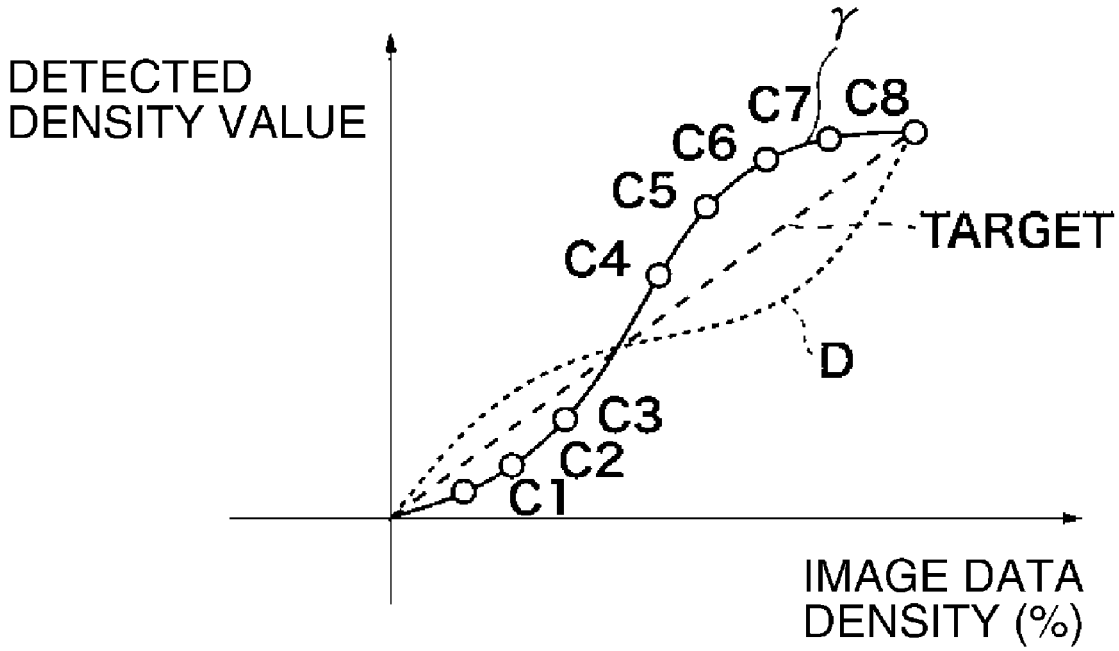
FIG. 12 is a graph showing a one-dimensional LUT stored in a RAM.

FIG. 12 is a graph showing the one-dimensional LUT stored in the RAM 53. The one-dimensional LUT is correction data for correcting input image data so as to make linear the relationship between the density of input image data and that of output image data. In FIG. 12, the horizontal axis represents the density of input image data, and the vertical axis represents values of the toner patch density detected by the sensor 41.

Further, in FIG. 12, a straight line TARGET represents target gradation characteristics in the image density control of the present embodiment.

Points C1, C2, C3, C4, C5, C6, C7, and C8 correspond to detected values of the respective cyan toner patches P, and the curve γ represents a detected values of each toner patch density. Here, the curve γ represents gradation characteristics in a state before execution of the image density control. A gradation density for which a toner patch is not formed in the curve γ is calculated by performing spline interpolation such that the curve γ passes the origin of the graph and the points C1 to C8.

A curve D represents a one-dimensional LUT calculated in the image density control. The curve D is calculated by obtaining symmetrical points to the curve γ before correction with respect to the target gradation characteristics TARGET. By correcting a detected density value based on the curve D, i.e. by multiplying the density of an input image by a value on the curve D, for example, the gradation characteristics of the density of an output image corresponding to that of the input image can be made closer to the target gradation characteristics TARGET.

The calculated (generated) one-dimensional LUT (curve D) is stored in the RAM 53 by replacing the existing one-dimensional LUT generated on a preceding occasion, whereby the update of the one-dimensional LUT is completed. Hereafter, the image forming apparatus corrects input image data based on the updated one-dimensional LUT and then forms an image based on the corrected image data, whereby images each formed with target densities can be obtained.

Figure 13:
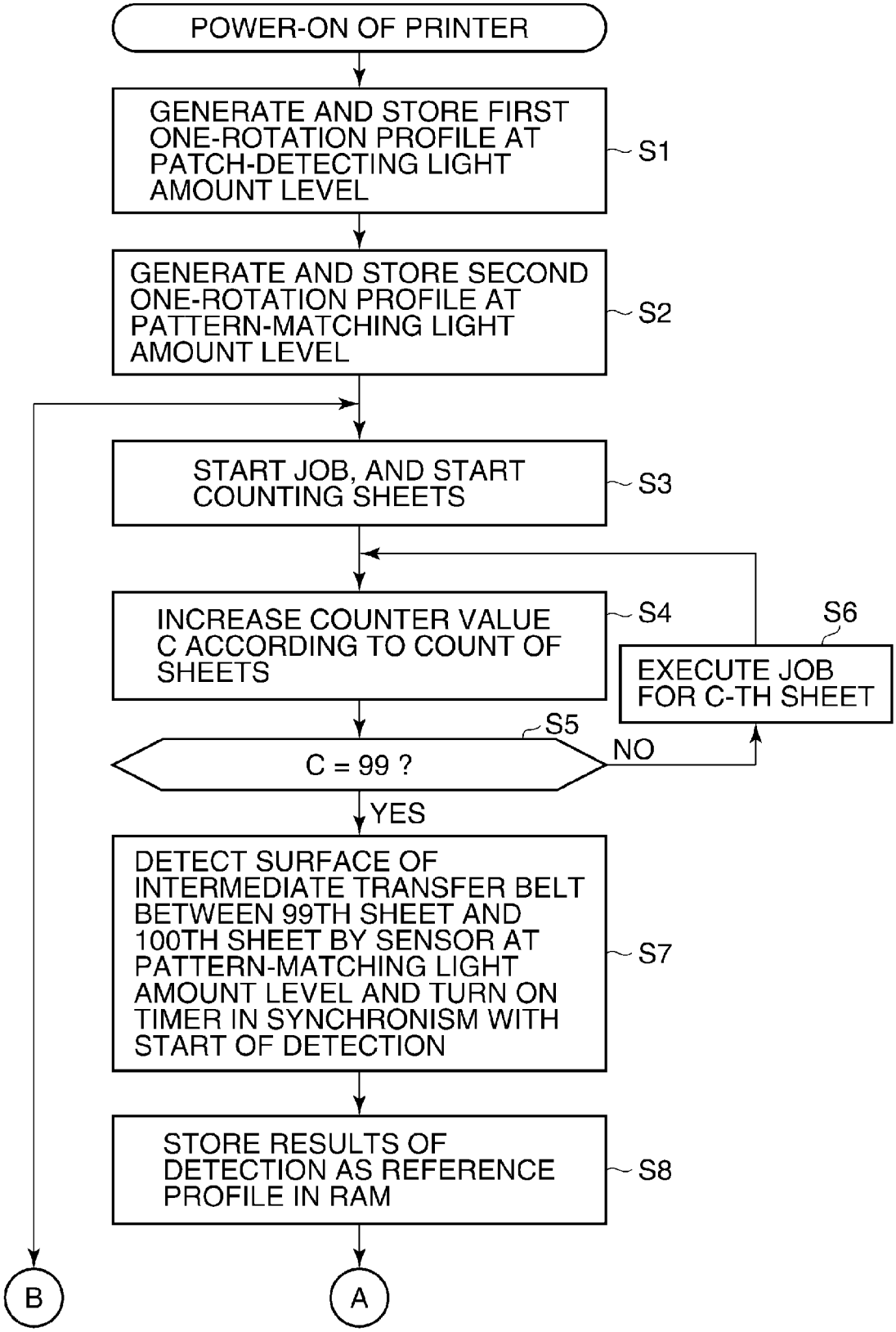
FIG. 13 is a flowchart of an image density control process.
Figure 14:
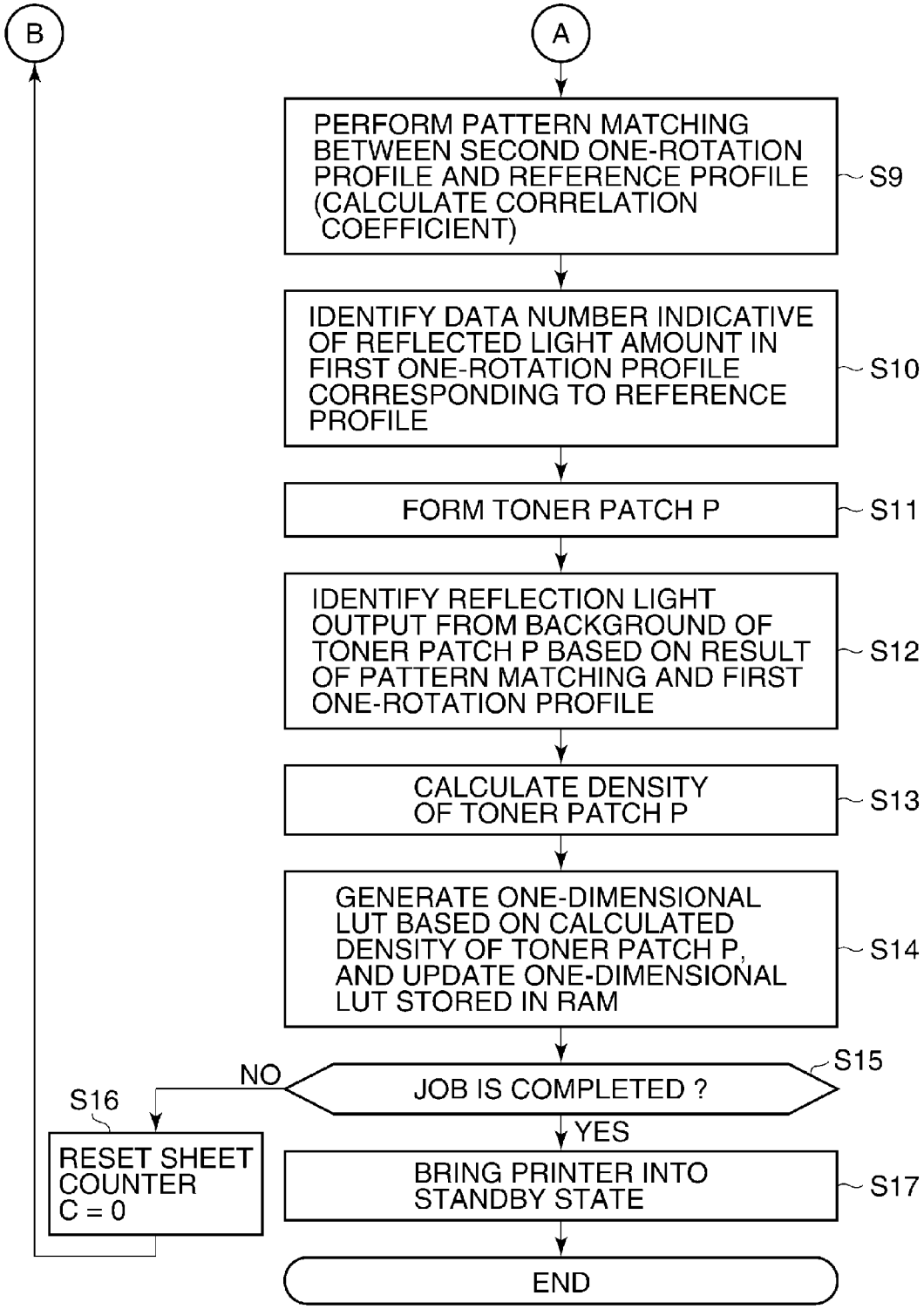
FIG. 14 is a continuation of FIG. 13.

Next, a description will be given of the image density control executed by the image forming apparatus. FIGS. 13 and 14 are a flowchart of an image density control process. A control program implementing the image density control process is stored in the ROM 52 and is executed by the CPU 51.

When the power of the printer is turned on, the CPU 51 causes the intermediate transfer belt 27 to perform one rotation without carrying toner thereon and causes the sensor 41 to detect specular reflection light from the surface of the intermediate transfer belt 27 during the one rotation, while causing the sensor 41 to operate at the patch-detecting light amount level. The results of the reading are sent to the RAM 53 and are stored therein as the first one-rotation profile (step S1).

Then, the CPU 51 causes the intermediate transfer belt 27 to perform one more rotation without carrying toner thereon and causes the sensor 41 to detect specular reflection light from the surface of the intermediate transfer belt 27 during the one rotation, while causing the sensor 41 to operate at the pattern-matching light amount level this time. The results of the reading are sent to the RAM 53 and are stored therein as the second one-rotation profile (step S2).

After execution of the step S2, the CPU 51 starts a job in response to user input of electronic data to the printer (job start). When the job is started, the CPU 51 starts counting printed sheets (step S3).

The CPU 51 increases a counter value C of a sheet counter according to the number of the printed sheets (step S4). Then, the CPU 51 determines whether or not the counter value C is equal to a predetermined value (step S5). In the present embodiment, the toner patches P are formed in timing in which the number of printed sheets reaches 100. For this reason, the predetermined value is set to a value of 99. More specifically, in the step S5, the CPU 51 determines whether or not the current job is performing image formation on a 99th sheet.

If it is determined in the step S5 that the current job is not performing image formation on the 99th sheet, the CPU 51 causes the printer to execute a next job for image formation (step S6). On the other hand, if it is determined in the step S5 that the current job is performing image formation on the 99th sheet, the CPU 51 causes the sensor 41 to detect a portion of the surface of the image carrier between page images immediately after completion of the job for the 99th sheet (step S7).

At this time, the sensor 41 is controlled to operate at the above-mentioned pattern matching LED light amount level. Further, the CPU 51 turns on the timer 55 upon the start of detection to start time measurement.

The CPU 51 sends the results of the detection performed by the sensor 41 in the step S7 to the RAM 53, and the data is stored as the reference profile in the RAM 53 (step S8).

The CPU 51 calculates a plurality of correlation coefficients based on the above-mentioned equations (4) to (7) so as to derive a correlation between the second one-rotation profile and the reference profile, to thereby perform pattern matching between the second one-rotation profile and the reference profile (step S9). In the present embodiment, 910 correlation coefficients are calculated. The CPU 51 identifies a data number corresponding to a data item indicative of a leading portion of reflection light output from the reference profile, based on the results of the pattern matching (step S10).

After an image for the 99th sheet has been formed, the CPU 51 causes the image forming units (toner image forming units) to form toner patches P on the intermediate transfer belt 27 (step S11). With reference to the identified data number, the toner patches P start to be formed from a portion of the intermediate transfer belt 27, which reaches the detection position of the sensor 41 T seconds after turn-on of the timer 55 in the step S7.

The CPU 51 identifies the background data of the toner patches P based on information indicative of the location of data in the second one-rotation profile corresponding to the reference profile, e.g. the aforementioned identified data number, and respective locations where which the toner patches P are formed, e.g. data numbers associated therewith (step S12). The processing executed in the steps S9 to S12 corresponds to the function of a circumferential location identification unit.

The CPU 51 calculates the toner patch density DENS_AVE using the toner patch background data identified in the step S12 and detected data of the toner patches measured by the sensor 41 (step S13). The density calculation method is the same as described hereinbefore.

The CPU 51 generates a one-dimensional lookup table (LUT) for image processing based on the calculated toner patch density DENS_AVE to thereby update the one-dimensional LUT stored in the RAM 53 (step S14).

Thereafter, the CPU 51 determines whether or not the job has been completed (step S15). If the job has not been completed, i.e. if the image forming operation is to be continued, the CPU 51 resets the sheet counter (step S16), followed by the process returning to the step S3. On the other hand, if the job has been completed, the CPU 51 brings the printer into a standby state (step S17), followed by terminating the present process.

As described above, according to the image forming apparatus of the present embodiment, it is possible to identify the amount of reflected light from any location on the intermediate transfer belt in a short time by a simplified construction. Thus, the amount of reflected light from the intermediate transfer belt as the background of toner patches can be acquired in a short time.

Further, in the case of detecting the amount of reflected light from the intermediate transfer belt corresponding to one rotation of the intermediate transfer belt so as to perform pattern matching, the amount of light to be emitted from the light emitter and/or output gain of the light receiver are/is increased, so that it is possible to prevent a plurality of candidate phases from being provided.

Furthermore, since reflection light output from a space between page images on the intermediate transfer belt is detected, it is possible to acquire the amount of reflected light from the intermediate transfer belt while forming an image, to thereby update the one-dimensional LUT (image forming conditions) in a short time.

It should be noted that the first and second one-rotation profiles in the present embodiment are detected immediately after power-on of the image forming apparatus and are stored in the RAM 53. Further, the CPU 51 causes the intermediate transfer belt 27 to perform two rotations after completion of image forming operation for a predetermined number of sheets, whereby the first and second one-rotation profiles are detected again during the respective rotations to thereby update the first and second one-rotation profiles stored in the RAM 53. The predetermined number of sheets may be 1000 sheets, for example.

Figure 15A:
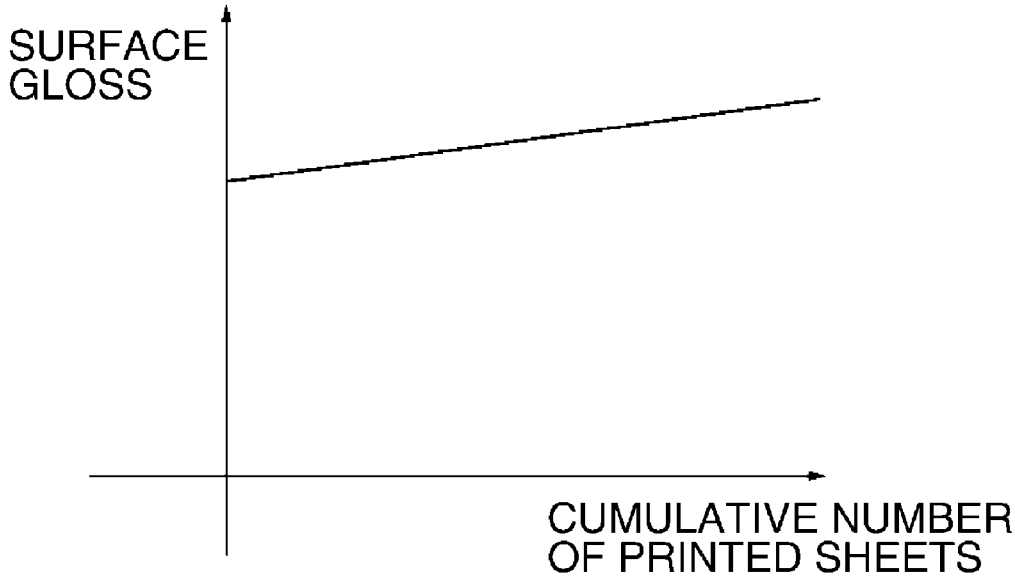
FIG. 15A is a graph of surface gloss representing the surface conditions of the intermediate transfer belt which vary with the cumulative number of printed sheets.
Figure 15B:
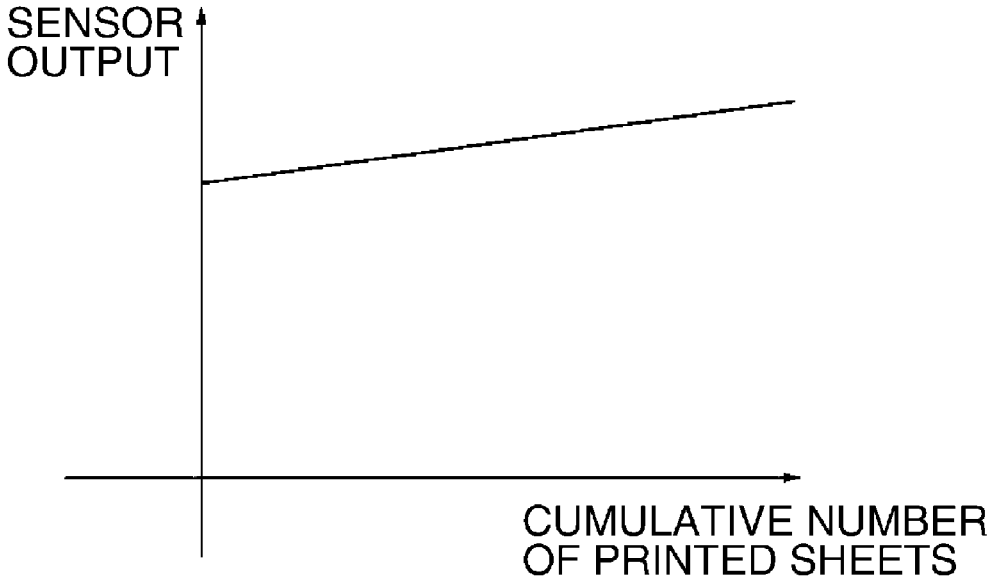
FIG. 15B is a graph of sensor output representing the surface conditions of the intermediate transfer belt which vary with the cumulative number of printed sheets.

The surface of the intermediate transfer belt 27 wears due to contact with a cleaning device for collecting remaining toner, and other members. For this reason, when images are repeatedly formed, gloss on the surface of the intermediate transfer belt 27 increases. FIGS. 15A and 15B are graphs showing the surface conditions of the intermediate transfer belt 27 which vary with the cumulative number of printed sheets. FIG. 15A shows how the surface gloss changes, and FIG. 15B shows how sensor output changes. To cope with the aging of the surface of the intermediate transfer belt 27, the image forming apparatus of the present embodiment performs processing for detecting the first and second one-rotation profiles again depending on the cumulative number of printed sheets (recorded sheets).

Further, the image forming apparatus of the present embodiment is configured to detect the reference profile immediately after completion of image forming operation for a 99th sheet. However, the reference profile may be detected not only immediately after completion of the image forming operation for the 99th sheet, but also before the image forming operation for the 99th sheet, or pattern matching may be performed between a plurality of reference profiles and the second one-rotation profile.

In a case where pattern matching is performed between a single reference profile and the second one-rotation profile, a plurality of pattern matching areas can be identified. More specifically, a plurality of correlation coefficients close to a value of 1 can be identified. However, by detecting from a plurality of areas a plurality of reference profiles associated therewith, respectively, and performing pattern matching using the plurality of reference profiles, it is possible to obtain more data groups for determining a correlation coefficient. This makes it possible to determine a more accurate correlation coefficient to thereby improve accuracy in pattern matching.

As described above, the method using pattern matching is effective as a method of identifying the amount of reflected light from the intermediate transfer belt in a short time by a simplified construction. In the method using pattern matching, pattern matching is performed between the reflected light amount profile of a portion of the intermediate transfer belt exposed between sheets conveyed during execution of successive jobs (reference profile) and the reflected light amount profile of the intermediate transfer belt corresponding to one rotation of the intermediate transfer belt (second one-rotation profile), whereby the phase of the reference profile in the second one-rotation profile is detected.

Conventionally, when the surface gloss of an intermediate transfer belt is relatively even and therefore the distribution of the reflected light amount on the surface of the image carrier, which is detected by an optical sensor, is relatively uniform, a plurality of candidate phases are provided by pattern matching, which disables phase identification. In the present embodiment, however, since reflected light is detected at the pattern-matching light amount level which is different from the patch-detecting light amount level, it is possible to prevent a plurality of candidate phases from being provided by pattern matching.

Figure 16A:
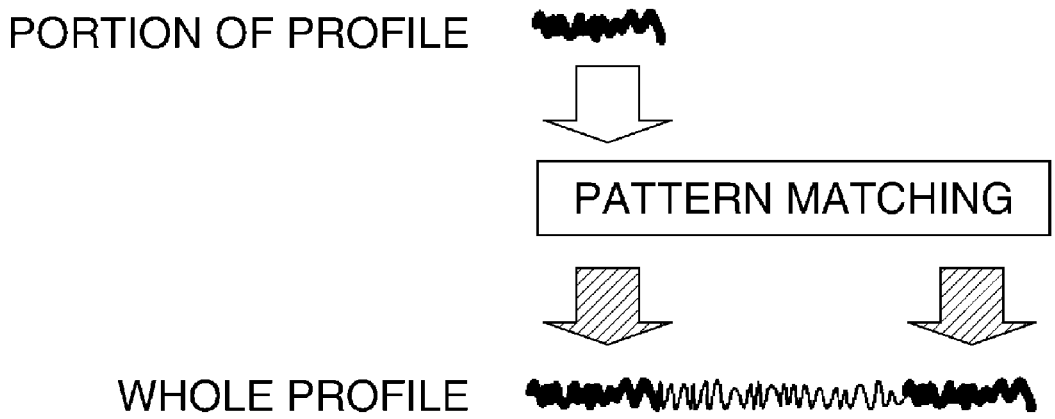
FIG. 16A is a view showing conventional pattern matching.
Figure 16B:
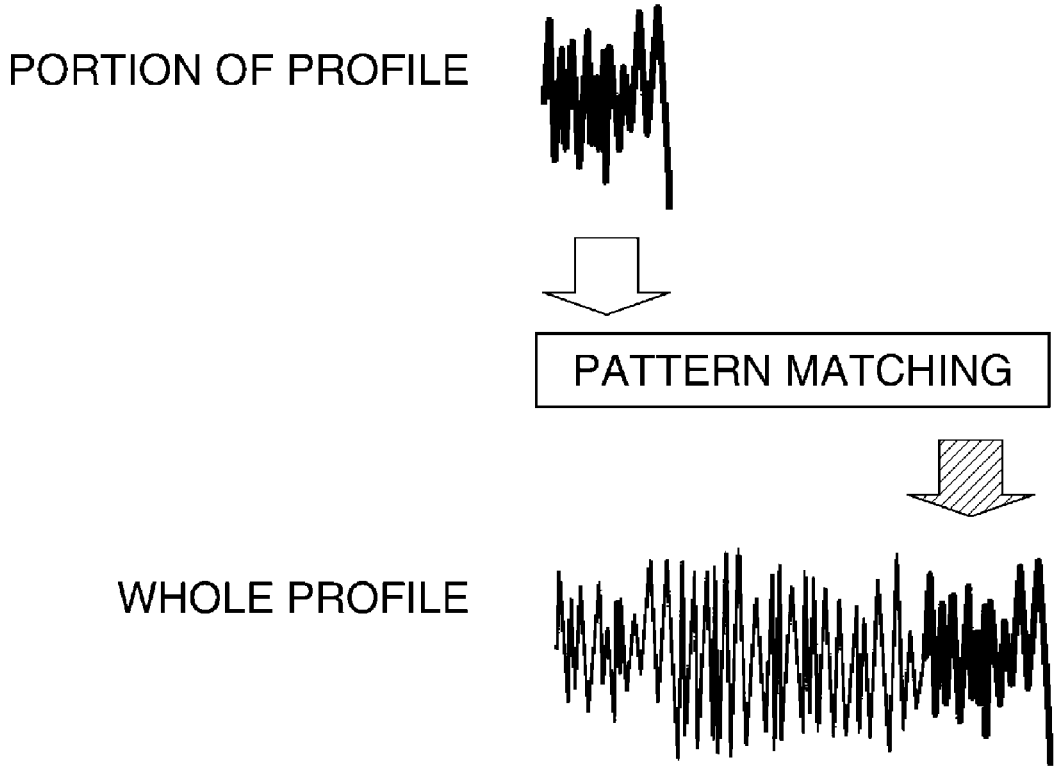
FIG. 16B is a view showing pattern matching in the first embodiment.

FIGS. 16A and 16B are views for comparison between the pattern matching in the first embodiment and the conventional pattern matching. In the conventional pattern matching shown in FIG. 16A, the LED light amount is small, and hence two or more candidate phases are provided by color matching. On the other hand, in the pattern matching in the present embodiment shown in FIG. 16B, since the LED light amount is large, only one candidate phase is provided. Thus, phase identification is facilitated.

An image forming apparatus according to a second embodiment performs pattern patching by a different method from the method executed in the first embodiment. The construction of the image forming apparatus according to the second embodiment is the same as that of the image forming apparatus according to the first embodiment, and therefore description thereof is omitted. Further, a density calculation process and a density control process are also the same as those in the first embodiment except for pattern matching, and therefore description of the density calculation process and the density control process is omitted.

In the pattern matching in the second embodiment, first, the CPU 51 calculates the absolute value of the difference between each of eighty data items of a data group extracted from the second one-rotation profile and the reference profile. Then, when the total sum of the absolute values calculated on a data group is smaller than that on any other data group, the CPU 51 determines that the pattern of the data group of which the calculated total sum is the smallest matches that of the reference profile.

The pattern matching will be described in detail. First, the CPU 51 extracts a continuous sequence of eighty data items from the second one-rotation profile formed by 910 data items. The CPU 51 calculates the differences between each of the extracted eighty continuous data items D(i) and the respective associated eighty data items d(i) of the reference profile. More specifically, when data items D(0) to D(79) are extracted, the CPU 51 calculates the absolute value of the difference between the data item D(0) and the data item d(0) corresponding to the data item D(0). Similarly, the CPU 51 calculates the absolute value of the difference between the data item D(1) and the data item d(1) corresponding to the data item D(1).

Then, when eighty absolute values are thus calculated, the CPU 51 determines the total sum of the calculated absolute values. The CPU 51 continues this operation and determines an extracted data group of which the calculated total sum is the smallest as having a pattern matching that of the reference profile.

Thus, the pattern matching performed by the image forming apparatus of the second embodiment can provide the same advantageous effect as provided in the first embodiment. The pattern matching method can be modified in various manners to perform more accurate pattern matching.

It should be noted that the present invention is not limited to the above-described embodiments, but can be modified in various manners based on the subject matter of the present invention, which should not be excluded from within the scope of the present invention insofar as functions as recited in the appended claims or the functions performed by the construction of each of the above described embodiments can be achieved.

For example, one of the pattern matching methods in the respective first and second embodiments may be selectively employed, or alternatively the two methods may be both employed. In the latter case, when results obtained by the two pattern matching methods do not coincide with each other, pattern matching is performed again. In this case, since the multiple pattern matching methods are employed, it is possible to achieve more accurate pattern matching.

The image forming apparatus of the present invention is implemented by an electrophotographic image forming apparatus, and as the image forming apparatus of this type, there can be mentioned a regular printing apparatus, a facsimile machine having a printing function, or a multifunction peripheral (MFP) provided with a print function, a copy function, a scan function, and so forth.

Further, although in the above-described embodiments, the electrophotographic image forming apparatus is implemented by a color image forming apparatus, the present invention may be applied to a monochrome image forming apparatus.

In the above-described embodiments, the image forming apparatus, which uses the intermediate transfer member, sequentially transfers toner images in the respective colors onto the intermediate transfer member in superimposed relation, and then transfers the full-color toner image carried by the intermediate transfer member onto a recording medium in a single operation. However, the invention is not limited to this transfer method, but the image forming apparatus may be configured to use a recording medium carrier and sequentially transfer toner images in the respective colors onto the recording medium carrier in superimposed relation. The intermediate transfer member may be implemented not only by a belt, but also by a drum.

Further, the shapes and relative positions of the component parts described in the above-described embodiments can be changed, as deemed appropriate, according to the arrangement of an apparatus to which the present invention is applied, and various conditions, and therefore it is to be understood that the present invention is by no means limited to the disclosed exemplary embodiments.

Furthermore, a sheet is not particularly limited in respect of its material and shape, but a paper medium, an OHP sheet, a thick sheet, and a tab sheet may be used.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-156770, filed Jul. 1, 2009, which is hereby incorporated by reference herein in its entirety.

What is claimed is:

1. An image forming apparatus that transfers a toner image carried by an image carrier onto a sheet, comprising:

a photo detector unit disposed in facing relation to the image carrier, for detecting reflected light from the image carrier;

a circumferential location identification unit adapted to perform pattern matching between amounts of reflected light detected by said photo detector unit during one rotation of the image carrier and an amount of reflected light detected by said photo detector unit from a specific portion of the image carrier in a circumferential direction of the image carrier, to thereby identify a first circumferential location of the specific portion of the image carrier in the circumferential direction of the image carrier and then identify a second circumferential location of a detection toner image formed on the image carrier based on the identified first circumferential location;

a density calculation unit adapted to calculate density of the detection toner image based on an amount of reflected light from the detection toner image, which is detected by said photo detector unit, and an amount of reflected light from a portion of the image carrier in the second circumferential location identified by said circumferential location identification unit, out of amounts of reflected light from the image carrier corresponding to one rotation of the image carrier, which are detected by said photo detector unit; and a density control unit adapted to control density of a toner image to be formed on the image carrier, according to the density of the detection toner image calculated by said density calculation unit;

wherein the specific portion of the image carrier is a portion of the image carrier exposed between toner images sequentially formed on the image carrier.

2. The image forming apparatus according to claim 1, wherein said photo detector unit includes a light emitter adapted to emit light to be irradiated onto the image carrier and a light receiver adapted to receive reflected light from the image carrier, and wherein the photo detector unit is adapted to be operable, when the amounts of reflected light corresponding to one rotation of the image carrier are to be detected for the pattern matching, to increase at least one of an amount of light emitted from the light emitter and an output gain of the light receiver in comparison with a case where the amounts of reflected light from the image carrier corresponding to one rotation of the image carrier are detected for calculation of the density of the detection toner image.

3. The image forming apparatus according to claim 1, wherein the specific portion comprises a plurality of specific portions, and said circumferential location identification unit performs the pattern matching between respective amounts of reflected light from the plurality of specific portions detected by said photo detector unit and the amounts of reflected light from the image carrier corresponding to one rotation of the image carrier, to thereby identify the first circumferential location of the specific portion in the circumferential direction of the image carrier.

4. The image forming apparatus according to claim 1, wherein said circumferential location identification unit determines a correlation coefficient between the amount of reflected light from the specific portion and each of the amounts of reflected light from the image carrier corresponding to one rotation of the image carrier, and performs the pattern matching based on the correlation coefficient.

5. The image forming apparatus according to claim 1, wherein said circumferential location identification unit calculates a difference between the amount of reflected light from the specific portion and an amount of reflected light extracted from the amounts of reflected light from the image carrier corresponding to one rotation of the image carrier, and performs the pattern matching such that the absolute value of the difference becomes minimum.

6. The image forming apparatus according to claim 1, wherein the amounts of reflected light from the image carrier corresponding to one rotation of the image carrier are detected by said photo detector unit when toner images corresponding to a predetermined number of sheets have been formed on the image carrier.

7. An image forming apparatus comprising:

an input unit adapted to input an original image;

an image forming unit adapted to form a page image corresponding to the original image input by said input unit on an image carrier;

a control unit adapted to control said image forming unit to form a measurement image on the image carrier;

a light emitting unit adapted to emit light;

a light detecting unit adapted to detect amounts of reflected light from the image carrier in a case where the image carrier reflects the light emitted from said light emitting unit, and detect amounts of reflected light from the measurement image in a case where the measurement image reflects the light emitted from said light emitting unit;

a storing unit adapted to store, as a profile data, the amounts of reflected light from the image carrier, corresponding to one rotation of the image carrier, that is detected by said light detecting unit;

an obtaining unit adapted to obtain a profile data realized at a position of the image carrier where the measurement image is formed, based on the profile data stored in said storing unit and the amounts of reflected light from the image carrier, corresponding to less than one rotation of the image carrier, that is detected by said light detecting unit; and a density control unit adapted to control a density of the page image, corresponding to the original image, that is formed by said image forming unit, based on the profile data obtained by said obtaining unit and a detection result by said light detecting unit while said light emitting unit emits the light to the measurement image on the image carrier.

8. An image forming apparatus according to claim 7, wherein the amounts of reflected light from the image carried corresponding to less than one rotation of the image carrier comprises amounts of reflected light realizing at a non-image portion on the image carrier where none of the page image and the measurement image is formed.

9. An image forming apparatus according to claim 7, wherein the page image comprises a plurality of page images continuously formed on the image carrier, and the amounts of reflected light from the image carried corresponding to less than one rotation of the image carrier comprises amounts of reflected light realizing at a non-image portion on the image carrier between the plurality of image pages continuously formed on the image carrier.

10. An image forming apparatus according to claim 7, wherein said storing unit stores the amounts of reflected light, corresponding to one rotation of the image carrier, that is detected by said light detecting unit before said image forming unit forms the page image.

11. An image forming apparatus according to claim 7, wherein said storing unit stores the amounts of reflected light, corresponding to one rotation of the image carrier, that is detected by said light detecting unit after said image forming unit has formed page images corresponding to a predetermined number of pages.

12. An image forming apparatus according to claim 7, wherein the amounts of light emitted to the image carrier by said light emitting unit when said light detecting unit detects the amounts of light of less than one rotation of the image carrier is identical with the amounts of light emitted to the image carrier by said light emitting unit when said storing unit stores the profiled data.

13. An image forming apparatus according to claim 7, wherein said density control unit includes a calculating unit calculates a density of the measurement image based on a difference between the profile data obtained by said obtaining unit and the detection result by said light detecting unit, wherein said density control unit controls the density of the page image, corresponding to the original image, that is formed by said image forming unit, based on the density of the measurement image calculated by said calculating unit.

* * * * *